US009115558B2

(12) United States Patent
Stang

(10) Patent No.: US 9,115,558 B2
(45) Date of Patent: Aug. 25, 2015

(54) APPARATUS AND METHOD FOR ABRASIVE PERFORATING AND CLEANOUT

(75) Inventor: Jonathan Michael Stang, Macklin, CA (US)

(73) Assignee: Stang Technologies Ltd., Macklin, SK (CA)

( * ) Notice: Subject to any disclaimer, the term of this patent is extended or adjusted under 35 U.S.C. 154(b) by 436 days.

(21) Appl. No.: 13/188,526

(22) Filed: Jul. 22, 2011

(65) Prior Publication Data

US 2012/0205108 A1 Aug. 16, 2012

Related U.S. Application Data

(60) Provisional application No. 61/367,167, filed on Jul. 23, 2010.

(51) Int. Cl.
*E21B 21/10* (2006.01)
*E21B 43/114* (2006.01)

(52) U.S. Cl.
CPC ..... *E21B 21/103* (2013.01); *E21B 43/114* (2013.01)

(58) Field of Classification Search
None
See application file for complete search history.

(56) References Cited

U.S. PATENT DOCUMENTS

| | | | | |
|---|---|---|---|---|
| 6,874,579 | B2 | 4/2005 | Johnson et al. | |
| 6,889,771 | B1 * | 5/2005 | Leising et al. | 166/373 |
| 7,090,020 | B2 * | 8/2006 | Hill et al. | 166/373 |
| 7,168,491 | B2 | 1/2007 | Malone et al. | |
| 7,213,648 | B2 | 5/2007 | Hayes et al. | |
| 7,216,092 | B1 | 5/2007 | Weber et al. | |
| 7,568,525 | B2 | 8/2009 | Veselkov | |
| 8,312,925 | B2 * | 11/2012 | Trummer et al. | 166/278 |
| 2002/0062963 | A1 * | 5/2002 | Eslinger et al. | 166/308 |
| 2006/0086504 | A1 | 4/2006 | Veselkov | |
| 2007/0284106 | A1 * | 12/2007 | Kalman et al. | 166/298 |
| 2008/0179061 | A1 | 7/2008 | McAfee | |
| 2010/0126725 | A1 * | 5/2010 | Ravensbergen | 166/297 |

* cited by examiner

*Primary Examiner* — Jennifer H Gay
*Assistant Examiner* — Caroline Butcher
(74) *Attorney, Agent, or Firm* — Peter L. Brewer; Baker Donelson

(57) ABSTRACT

An apparatus and a method of performing a plurality of operations in a wellbore with one direction of flow. A multicycle open/close valve (MCOCV) responsive to a plurality of flow rates is placed in a bottom hole assembly (BHA) and is used to perform abrasive perforating of a wellbore or cleanout of the wellbore using one direction of flow. At one or more first flow rates, the MCOCV is configured to operate in a first operating mode to abrasive perforate the wellbore. At one or more second flow rates, the MCOCV is configured to operate in a second operating mode to cleanout the wellbore. In an embodiment, the MCOCV includes a J-slot sequencing mechanism responsive to a sequence of flow rates to cycle the MCOCV through a plurality of operating modes.

25 Claims, 17 Drawing Sheets

APPARATUS AND METHOD FOR ABRASIVE PERFORATING AND CLEANOUT

CROSS-REFERENCE TO RELATED APPLICATIONS

This application claims the benefit of U.S. Provisional Application No. 61/367,167 titled "APPARATUS AND METHOD FOR ABRASIVE PERFORATING AND CLEANOUT USING A MULTI-CYCLE OPEN/CLOSE VALVE" filed on Jul. 23, 2010, the entirety of which is incorporated herein by reference.

FIELD OF THE INVENTION

The present invention relates generally to an apparatus and method for abrasive perforating and cleanout using a multi-cycle open/close valve. The present invention relates more specifically to an apparatus and method for operating an abrasive perforating apparatus by controlling whether the apparatus is abrasive perforating or cleaning out the wellbore based on the flow through the apparatus.

BACKGROUND

Abrasive perforating, which is an alternative to explosive charge perforating, is a common procedure in the oil and gas business used to create a communication path from a wellbore to a reservoir. The communication path is created by pumping fluid, normally containing an abrasive medium, through specialized jetting nozzles at high pressure. The fluid, when ejected from the jetting nozzles, erodes through the casing, cement and into the formation. Abrasive perforating can be performed using conventional tubing, but is more commonly carried out using coiled tubing (CT).

In many cases abrasive perforating is combined with a stimulation treatment using sand plugs or mechanical plugs for zonal isolation between the sets of perforations to allow each zone to be stimulated individually, if required, before creation of the next set of perforations.

Originally the procedure was conducted on vertical wells using a bottom hole assembly (BHA) containing a reverse ball check valve. Such a BHA is shown in FIG. 1 in an illustrative configuration, which, as with all BHAs in this application, may change based on well conditions and other variables. The BHA components may include a CT connector 10, a disconnect 20, a stabilizer 30, an abrasive cutting sub 40 with at least one jetting nozzle 50, another stabilizer 60, a reverse ball check valve 70 containing a pin 80 and ball 90, and finally a nozzle 100.

In this setup, when pumping fluid down the CT, the reverse ball check valve 70 is forced closed, preventing the fluid from exiting the nozzle 100 below (at the bottom of the BHA) and directing the fluid through the jetting nozzle(s) 50 in the portion of the BHA above.

When fill (sand or other) is required to be removed from the wellbore, it is conducted by performing a "reverse cleanout", meaning pumping fluid down the CT annulus and taking returns up the CT, in a reverse flow. The returns can also include the abrasive fluid used in the abrasive perforating process and, in the context of the present disclosure, this is considered to be included in reverse cleanout. A reverse cleanout flow for a BHA having a reverse ball check valve is shown in FIG. 2. During reverse cleanout the reverse ball check valve 70 allows fluid and fill from the wellbore to enter the nozzle 100 at the bottom of the BHA, enabling the fluid and fill to flow up to surface via the CT.

As shown in FIG. 3, in some BHAs, a double flapper check valve (DFCV) 12 is provided to regulate the flow direction, eliminating the usefulness of the reverse ball check valve 70. This is used, for example, in vertical high pressure wells. The DFCV 12, however, only allows fluid to flow in the CT in the conventional downward direction. If a cleanout is required with this BHA configuration for abrasive perforating, a completely separate BHA is needed on the end of the CT, or the current BHA needs to be brought to surface and modified, to remove the fill. FIG. 3 illustrates the two BHAs that are needed if the BHA has a DFCV 12. Therefore, to conduct abrasive perforating and cleanout using a BHA with a DFCV 12, the operator must alternate between using two completely separate apparatus, which results in significant time wastage and additional cycling fatigue of the CT.

Abrasive perforating has more recently also been adapted for horizontal wellbores. Different BHA configurations require different methods of abrasive perforating depending on wellbore conditions.

One method of abrasive perforating of a horizontal wellbore is by using the same method as typically used in vertical wells, using a BHA with a reverse ball check valve. This method has a risk of creating a "wormhole" in front of the BHA while conducting reverse cleanout, wherein reverse cleanout is only effective around the end of the BHA, resulting in a hole barely larger than the BHA and therefore the BHA eventually becoming stuck in the well. The reason this risk is more present in a horizontal wellbore than in a vertical wellbore is that, in the vertical wellbore, the fill will typically keep falling to the end (bottom) of the BHA by force of gravity and the annular flow velocity, enabling the fill to enter the BHA and travel up the CT for removal from the wellbore. However, in a horizontal wellbore, gravity does not bring the fill to the end of the BHA, so the only means of transporting the fill to the end of the BHA is by the annular flow of the cleanout medium from surface to the BHA end. Depending on the size of the wellbore and cleanout medium, the annular velocity may not be high enough to sweep the entire fill to the end of the BHA.

Another method that has been used for abrasive perforating of a horizontal wellbore is replacing the reverse ball check valve 70 with a one-way valve 72 having a ball seat 92 and a corresponding control ball 90, as shown in FIG. 4. A control ball 90 of corresponding size to the ball seat 92 is placed on the ball seat 92, either by manual placement while the BHA is at the surface of the worksite or by circulating the ball down the CT using fluid. When operating the BHA in the conventional forward direction, the ball 90 is urged against the ball seat 92, creating a seal and directing the flow through the jetting nozzle(s) 50, just as the reverse ball check would have done. The difference is that, with a ball 90 and ball seat 92, reverse circulation is only used to remove the ball 90 from the BHA, and not to remove fill from the wellbore. Once the ball 90 has been removed from the BHA and is caught at the surface of the worksite, pumping is again switched to the convention direction, taking returns of fill up the CT annulus for a cleanout of the fill from the wellbore. Similar to the case of a reverse ball check valve 70, two directions of flow in the BHA are required. Therefore, a DFCV cannot be used in this method. Furthermore, a BHA using a ball seat 92 and corresponding control ball 90 typically requires a more elaborate rig-up of treating iron that includes a ball catching/launching assembly.

Another existing method being used for horizontal wellbores uses a more lengthy approach using DFCV 12 when the well conditions so require (e.g. high pressure/operational procedures/result of risk assessment). This method, just as the case when a DFCV 12 is required in a vertical wellbore, requires two different BHA assemblies for perforating and cleanout. A cleanout can be performed before abrasive perforating when limited to one direction of flow in the CT (e.g. DFCV 12 present in the BHA) if a ball seat 92 is used below the cutting sub 40 containing the jetting nozzle(s) 50 in the BHA and the ball 90 is left out of the BHA when at surface. The cleanout is done then the ball 90 is circulated down to the ball seat 92 via the CT and seals off the lower section of the BHA. In this case, the process cannot be reversed and the BHA will now remain in abrasive perforating mode so if another cleanout is required the BHA will need to be brought to surface to have the ball 90 removed.

Other methods of abrasive perforating and fracturing have recently been developed which utilize a multi-set bridge plug (isolation and anchor assembly). Referring to FIG. 5, shown is another prior art BHA system which is similar to that shown in FIG. 1, except that it includes a circulating/equalizing valve component 110, a resettable bridge plug 120, and a mechanical casing collar locator (MCCL) 130.

Using the system shown, a method is to run the BHA in hole, locate casing collars with the MCCL 130 to correlate depth if the BHA is equipped with a MCCL 130, position on depth, reciprocate the BHA to set the packer, establish circulation down the coiled tubing at the calculated perforating rates, pump fluid containing an abrasive medium, such as sand, through the jetting nozzle(s) to abrasive perforate the casing and formation, displace the abrasive slurry up hole or out of the well and execute the fracture treatment down the CT annulus. After the frac treatment a straight pull on the tubing opens an equalizing valve and unsets the packer. Then the tools are pulled up hole to the next interval to be treated and the BHA is cycled with mechanical movement back into setting position to set the tools at the next stage (depth to be perforated and fractured). At this time the BHA can be pressure tested to ensure the packer has a good seal and the process is repeated.

Another prior art method is to utilize the same primary BHA components as shown in FIG. 5 with the exception of a sliding sleeve locator in the place of the MCCL. That is, in addition to a specialized BHA, the system also consists of sliding sleeves, which are inserted in the casing string when completing a well wherever a frac is planned. To gain communication to the formation for the frac treatment the sliding sleeve is opened by the running string (BHA and CT) by setting the multi-set bridge plug inside the sleeve and then moving in hole to shift the sleeve down and open. The anchors on the bridge plug provide the means of transferring the force to the sliding sleeve for shifting it. As a contingency measure, at least one abrasive perforating nozzle is included in the BHA so perforations can be made for communication to the reservoir in the event a sliding sleeve will fail to open or if the wellbore is to be perforated (and possibly fractured) in an area a sliding sleeve was not placed when running the casing in the early stages of the well. During the frac treatment, with both of these systems, sand laden fluid is being pumped down the CT annulus and there is a potential for the sand to settle on top of the bridge plug and may cause a "stuck in hole" situation. In some instances a "screen out" can occur during a frac job, which is when the maximum pumping pressure is reached and an unplanned amount of sand laden fluid is in the wellbore and is not able to be displaced into the formation. This has a high potential for causing the BHA to become stuck in the hole. In this case, with the current two systems the contingency would most likely be to commence pumping down the CT and through the BHA with fluid exiting the abrasive jetting nozzle(s) to circulate the sand/sand laden fluid out of the annulus and off of the BHA in the conventional direction. Because of the high pressure drop of the abrasive jetting nozzle(s) flowrate down the CT, and consequently annular velocities required to remove sand, will be lower than they would be without the high back pressure. There is the ability to reverse circulate (down the annulus/up the CT) because of the ball and seat in circulating/equalizing valve, but when sand concentration in the annulus is high this is not a good option due to the high risk of plugging of the CT if this high concentration sand laden fluid enters the CT.

Each of the prior art methods of abrasive perforating, whether in vertical or horizontal wellbores, requires either reversing circulation, use of two assemblies or removal of the BHA to the surface when a cleanout is required following abrasive perforating. All of these options are time consuming and in some cases not an option such as when a frac treatment screens out while using the prior art system of FIG. 5 and becoming stuck in hole is a risk and high rate forward circulation is the only way to get the fill removed and free the BHA. What is required, therefore, is a means for abrasive perforating in which a single assembly can be used in a single flow direction for both abrasive perforating and cleanout and which can be controlled without removing the BHA from the wellbore.

SUMMARY

The present invention provides an apparatus and method for abrasive perforating and cleanout using a multi-cycle open/close valve.

The present invention also provides a method for conducting abrasive perforating of a wellbore, the method comprising: (a) placing a bottom hole assembly in the wellbore; (b) configuring the bottom hole assembly to conduct abrasive perforating by pumping fluid into the bottom hole assembly at one or more first flow rates; (c) pumping fluid into the bottom hole assembly to abrasive perforate the wellbore; (d) configuring the bottom hole assembly to conduct cleanout of the wellbore by pumping fluid into the bottom hole assembly at one or more second flow rates; and (e) pumping fluid into the bottom hole assembly to cleanout the wellbore.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE DRAWINGS

The invention will be better understood and objects of the invention will become apparent when consideration is given to the following detailed description thereof. Such description makes reference to the annexed drawings wherein.

Figure 1:
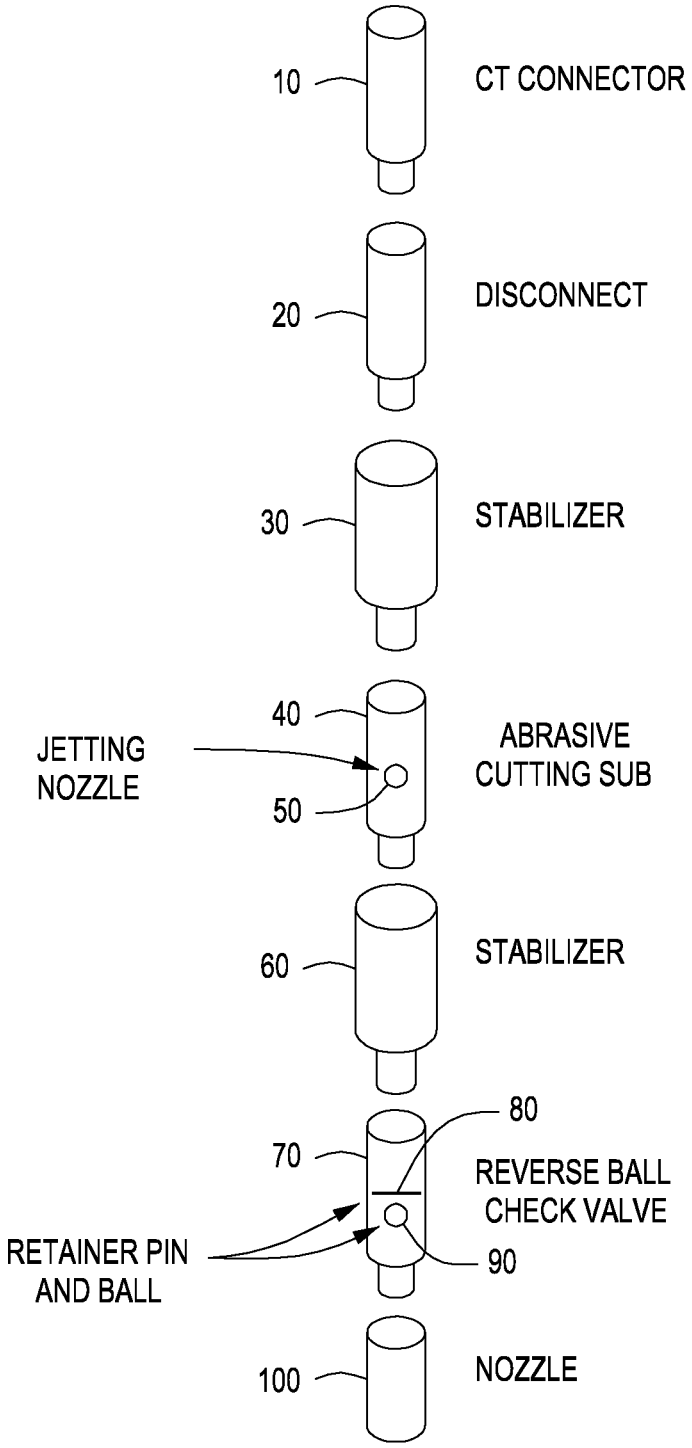
FIG. 1 (PRIOR ART)
FIG. 1 illustrates an abrasive perforating bottom hole assembly using a reverse ball check valve of the prior art.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

Unless defined otherwise, all technical and scientific terms used herein have the same meaning as commonly understood by one of ordinary skill in the art to which this invention belongs. Also, unless indicated otherwise, except within the claims, the use of "or" includes "and" and vice-versa. Non-limiting terms are not to be construed as limiting unless expressly stated or the context clearly indicates otherwise (for example "including", "having" and "comprising" typically indicate "including without limitation"). Singular forms including in the claims such as "a", "an" and "the" include the plural reference unless expressly stated otherwise.

The invention will be explained in details by referring to the figures. The present invention provides an apparatus and method for abrasive perforating by varying the rate of fluid pumped into a bottom hole assembly (BHA). Fluid may be pumped into the BHA at the surface. The BHA is placed in a wellbore. The BHA can be configured to conduct abrasive perforating by pumping fluid into the bottom hole assembly at one or more first flow rates. Fluid can then be pumped into the BHA to abrasive perforate the wellbore. The BHA can be configured to conduct cleanout of the wellbore by pumping fluid into the bottom hole assembly at one or more second flow rates. Fluid can then be pumped into the BHA to cleanout the wellbore.

Figure 5:
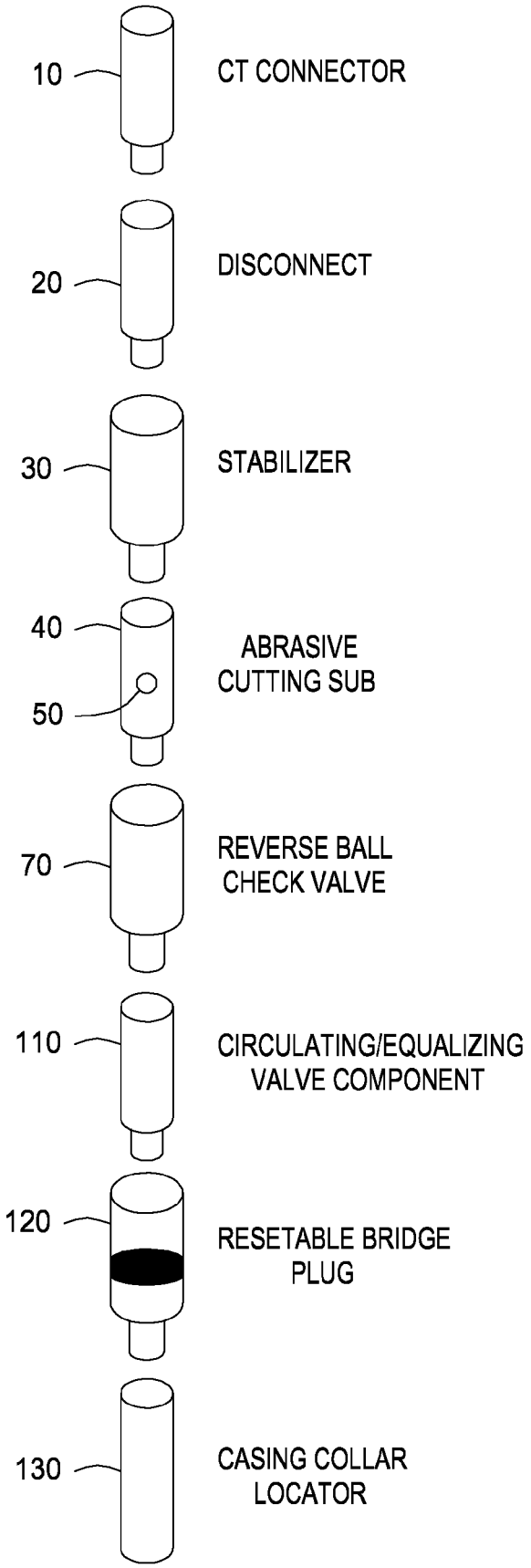
FIG. 5 illustrates a multi stage frac system bottom hole assembly with a resettable bridge plug of the prior art.

A BHA usable in accordance with the present invention comprises one or more jetting nozzles disposed between a surface end and a bottom end of the BHA, and an opening at the bottom of the BHA (or in the case of the improvements to the systems in FIG. 5, above the resettable bridge plug). Fluid exits from the jetting nozzle(s) of the BHA to conduct abrasive perforating. Fluid exits from the bottom of the BHA (or in the case of the improvements to the systems in FIG. 5, above the resettable bridge plug) to conduct cleanout of the wellbore. The fluid at both the first flow rates and second flow rates is pumped down the BHA, and the BHA is not required to be used in reverse circulation, nor is it required to be removed from the wellbore. The operation of the BHA between abrasive perforating and cleaning out can be controlled by cycling the fluid between the first fluid rates and the second flow rates.

Figure 6:
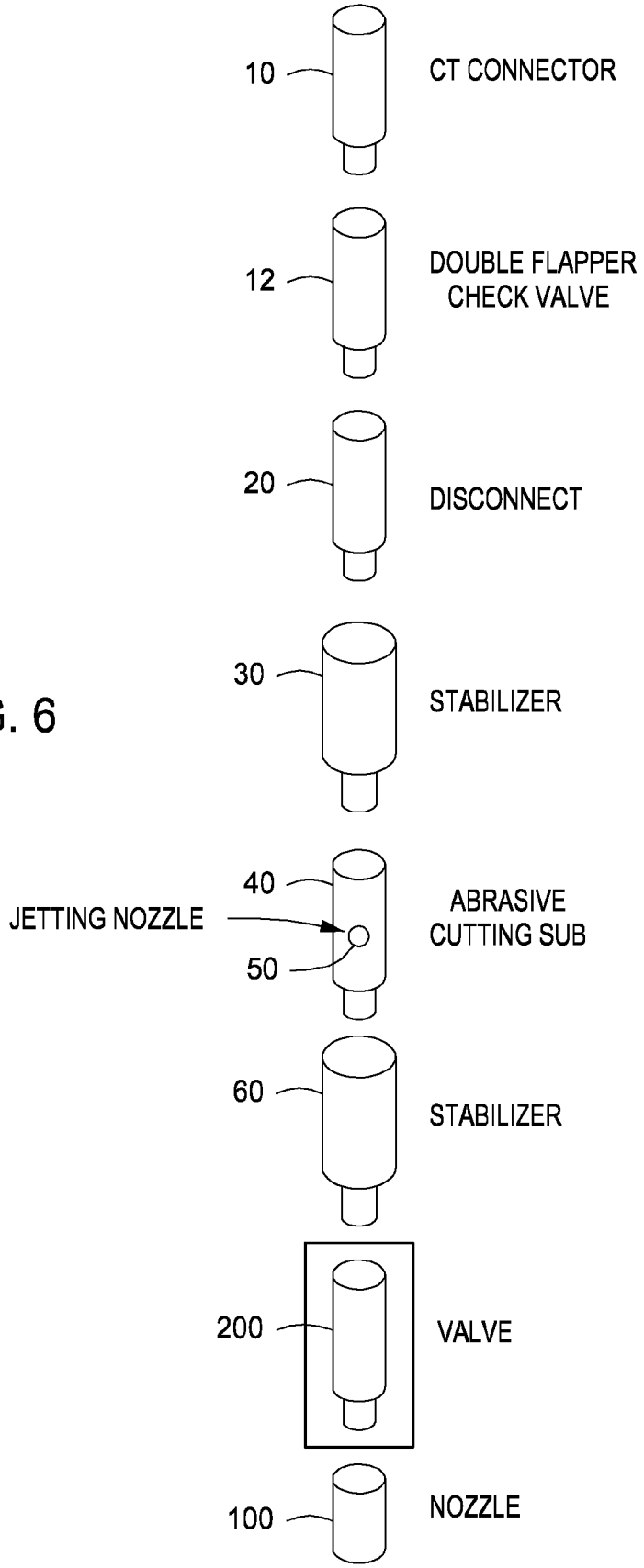
FIG. 6 illustrates an abrasive perforating bottom hole assembly usable in accordance with an embodiment of the present invention with the jetting nozzle(s) in a separate component of the BHA than a multi-cycle open/close valve.
Figure 7:
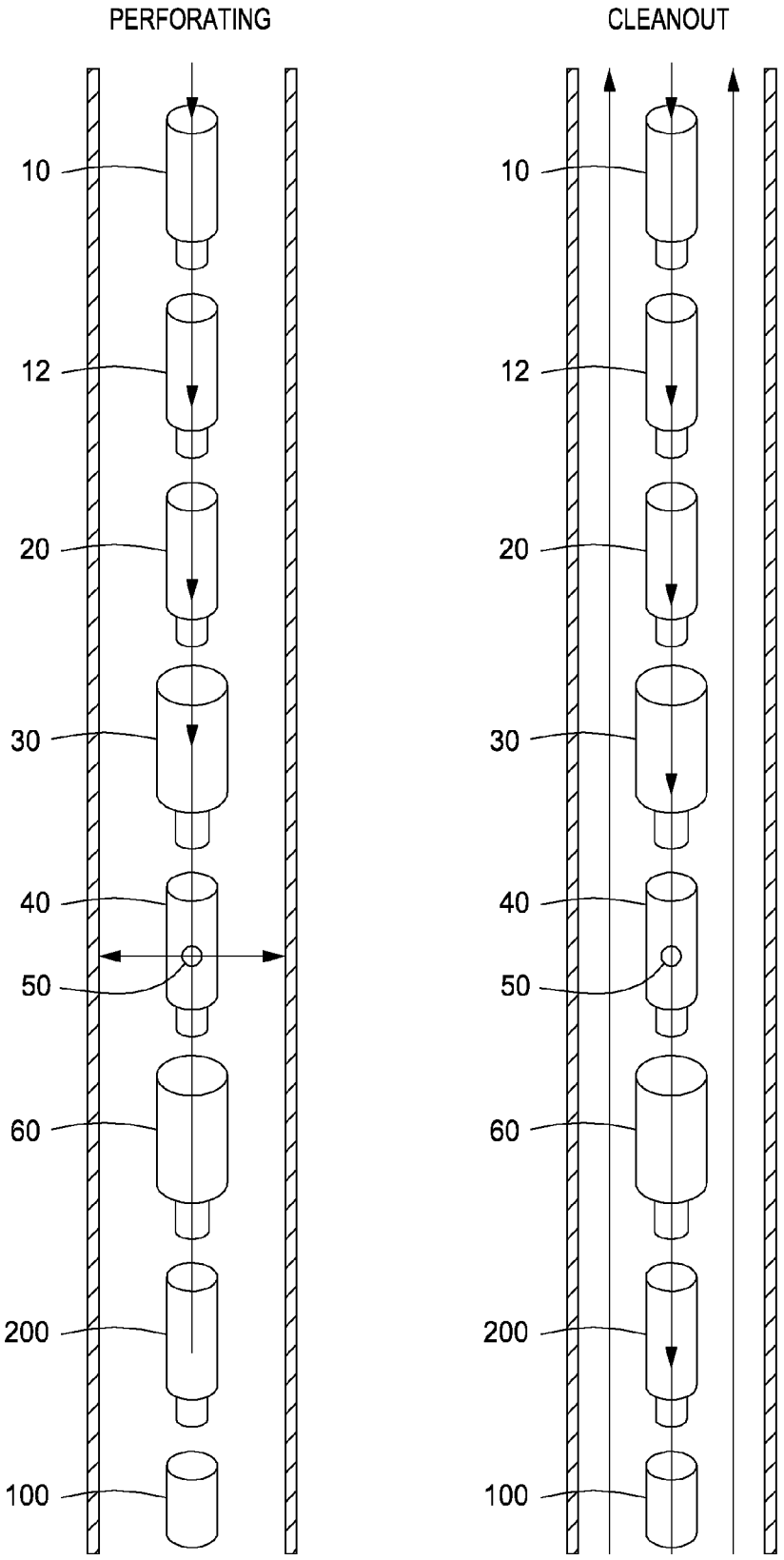
FIG. 7 illustrates a method of perforating and cleanout in accordance with an embodiment of the present invention using the assembly previously illustrated in FIG. 6.
Figure 8:
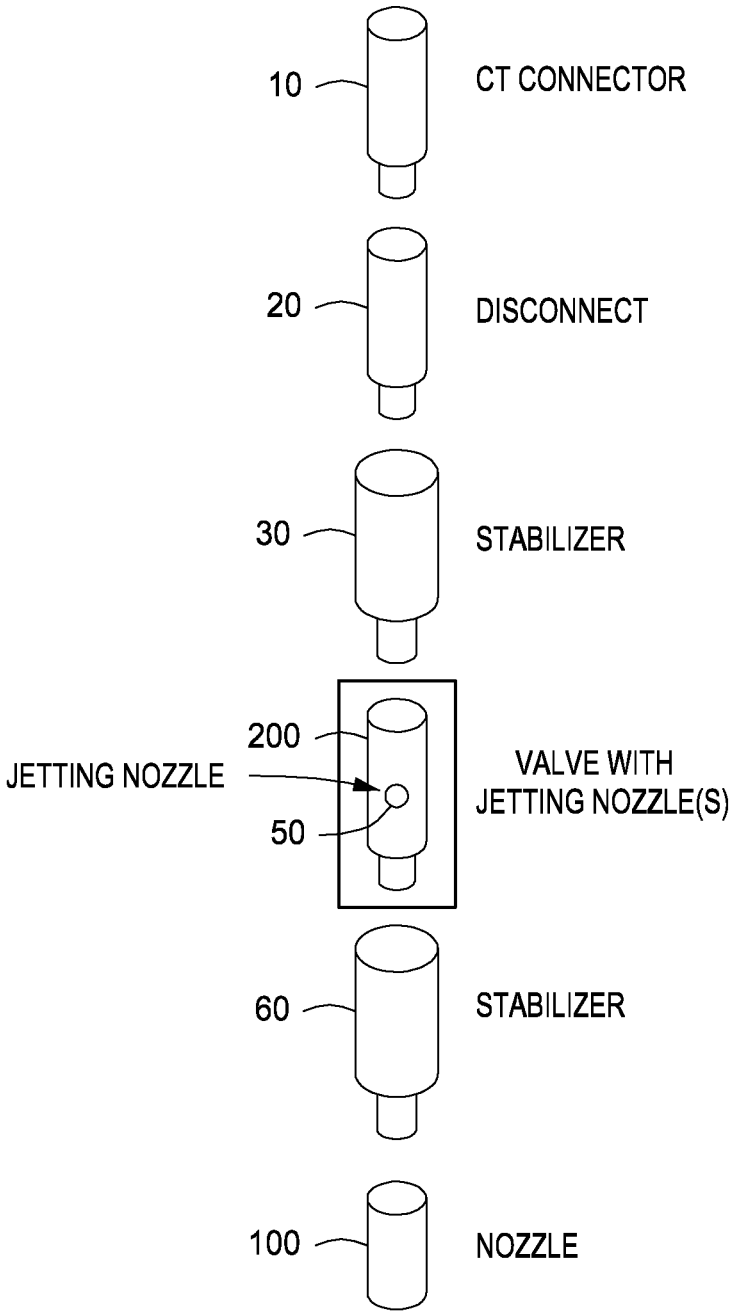
FIG. 8 illustrates an abrasive perforating bottom hole assembly usable in accordance with an embodiment of the present invention with the jetting nozzle(s) included in a multi-cycle open/close valve.

The first flow rates and second flow rates may be any particular sequence of one of more rates, depending on the particular BHA provided. In order to implement such a BHA, as shown in FIG. 6, a multi-cycle open/close valve (MCOCV) 200 may be provided in the BHA. In one example implementation, the MCOCV 200 is positioned between the jetting nozzle(s) 50 and the bottom of the BHA. The MCOCV 200, in this example, is moveable between an open position for cleanout and a closed position for abrasive perforating by varying the rate of fluid incident on the MCOCV 200. The MCOCV 200 can be implemented as a separate component in the BHA, positioned between the jetting nozzle(s) 50 and the bottom of the BHA as in FIG. 6, or the jetting nozzle(s) 50 could be incorporated into the MCOCV 200 to work as a single component of the BHA as shown in FIG. 8, for example. In an embodiment, the MCOCV 200 may be controlled based on different flow rates. This may include, for example, first flow rates and second flow rates for switching between different operating modes. In an embodiment, the first flow rates may be one flow rate or more than one flow rate in a particular sequence. For example, if it is one flow rate, it may be a particular flow rate sufficiently high to close the MCOCV 200, requiring fluid to exit from the jetting nozzle(s) 50. Similarly, the second flow rates may be one flow rate that is sufficiently low to leave the MCOCV 200 open, so that all or the majority of the fluid exits from the opening at the bottom of the MCOCV 200 to the portion of the BHA below. The rates may be any other set of rates. For example, the first flow rate could be lower than the second flow rate if desired.

Alternatively, the first flow rates and/or second flow rates could be a sequence or sequences of flow rates. For example, the first flow rate may be a particular sequence of flow rates that configures the MCOCV 200 to close. Similarly, the second flow rates may be a particular sequence of flow rates that configures the MCOCV 200 to open. This could, for example, be provided by a MCOCV 200 that comprises a J-slot mechanism 280 that enables the sequences of flow rates to configure the MCOCV 200.

One advantage provided by the present invention over the prior art as a whole is that only one direction of flow is required to conduct both abrasive perforating and cleanout using a single BHA, as can be seen more particularly in FIG.

Figure 9:
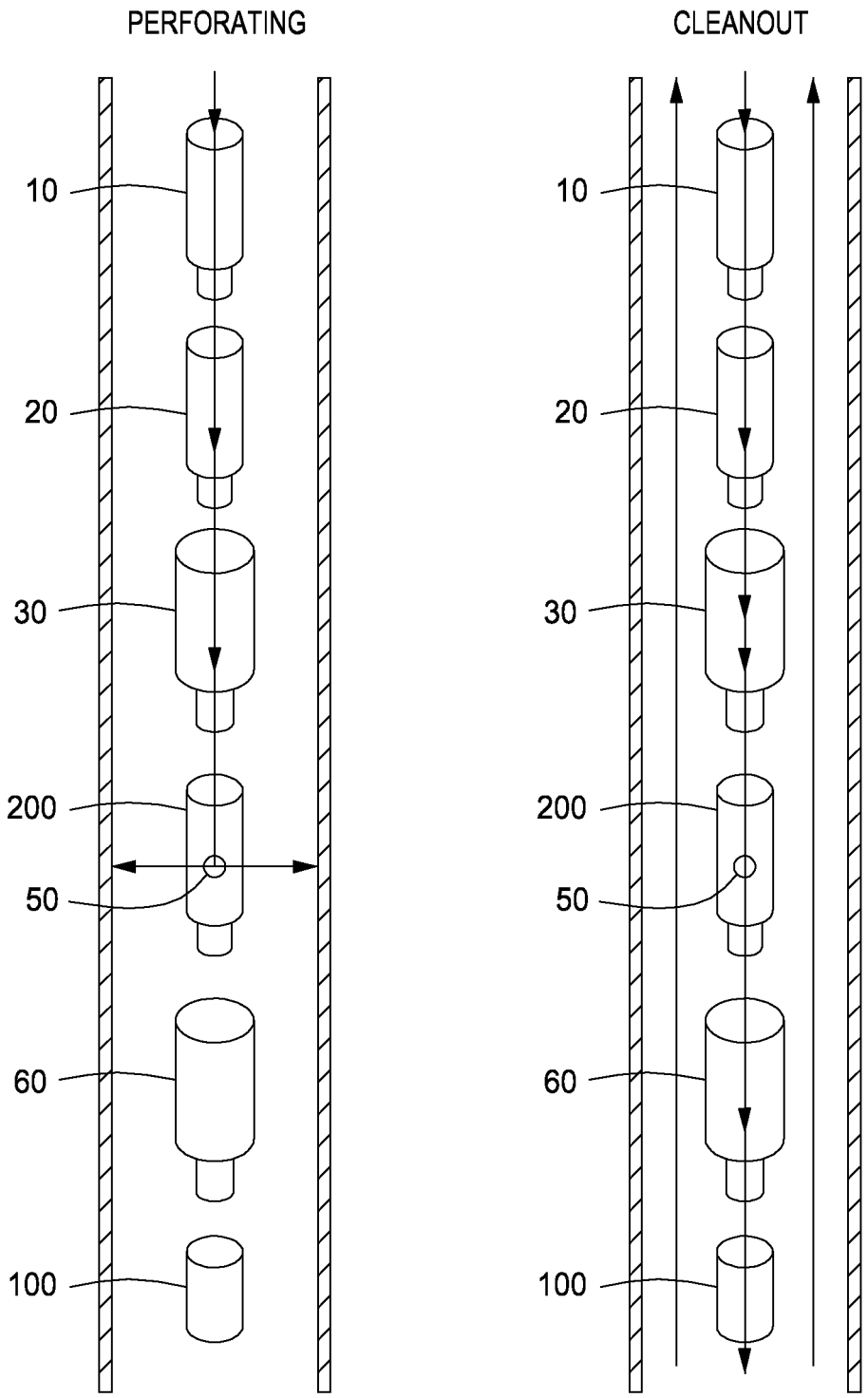
FIG. 9 illustrates a method of perforating and cleanout in accordance with an embodiment of the present invention using the assembly previously illustrated in FIG. 8.

7 and FIG. 9. This results in significant time savings and reduction in effort to operate the BHA.

More specifically, compared to a BHA with a reverse ball check valve 70 (shown previously in FIG. 1), a BHA used in accordance with the present invention could be operated with a DFCV 12, enabling the BHA to be used where health, safety and environmental risks require a DFCV 12, such as with a high pressure well. Furthermore, a BHA used in accordance with the present invention enables cleanout to be conducted in conventional manner (by pumping fluid down the CT and taking returns up the CT annulus). Thus a BHA used in accordance with the present invention is also better suited for horizontal wellbores than a BHA with a reverse ball check valve.

Figure 4:
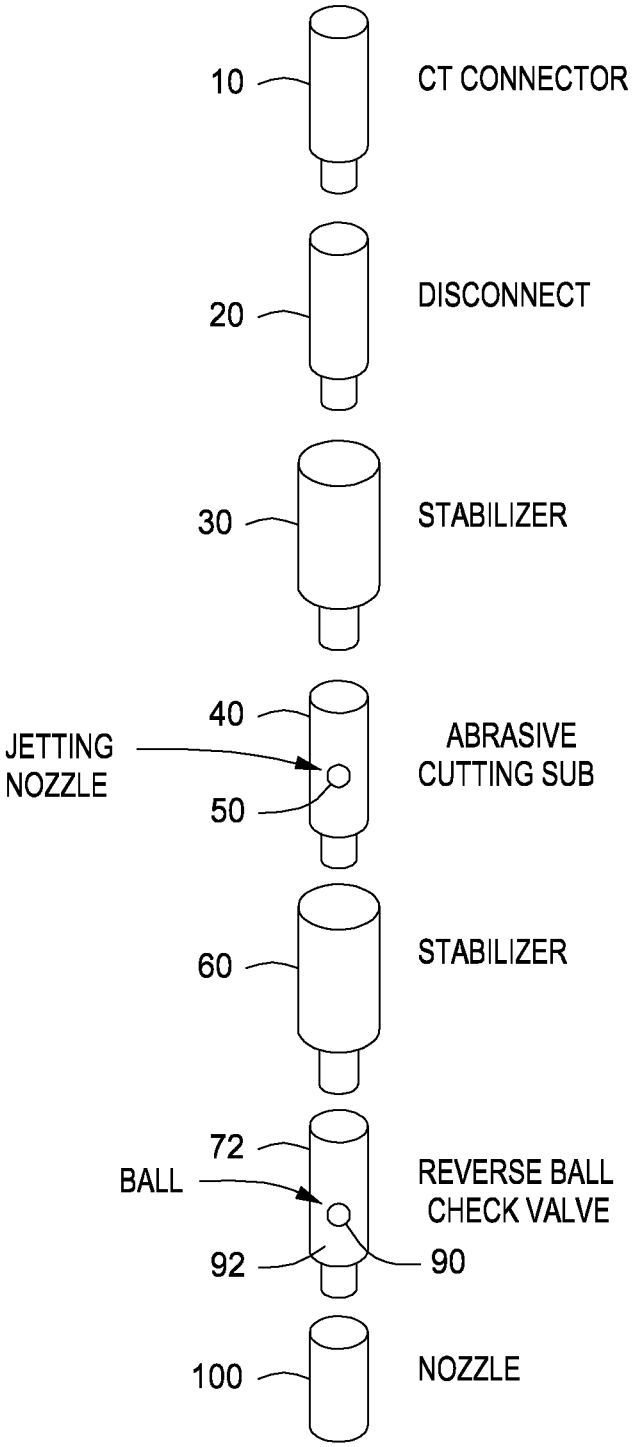
FIG. 4 (PRIOR ART)
FIG. 4 illustrates an abrasive perforating bottom hole assembly using a ball seat of the prior art.

As compared to a prior art BHA using a ball seat 92 and corresponding control ball 90 (shown previously in FIG. 4), a BHA in accordance with the present invention has the advantage of operability with a DFCV 12. Furthermore, although both BHAs conduct cleanout in the conventional manner, a BHA using a ball seat has the disadvantage that an additional amount of time is required to reverse circulate the ball to the surface to permit cleanout with the BHA. A BHA in accordance with the present invention does not have this disadvantage. This additional amount of time is not insignificant, since firstly, to remove the ball 90 the CT must be pulled up to a wellbore depth at which no large amounts of sand will enter the CT upon reverse circulation, which would otherwise potentially bridge off and plug the inside of the CT, and secondly a considerable amount of time is required to circulate the ball 90 back down to the ball seat 92 to configure the BHA for abrasive perforating following cleanout. Furthermore, a BHA using a ball seat 92 and corresponding control ball 90 typically requires an elaborate rig-up of treating iron, including a ball catching/launching assembly, which is not required for a BHA used in accordance with the present invention.

As compared to the conventional use of DFCV 12 requiring two BHAs, one for abrasive perforating and one for cleanout, the advantages of a BHA used in accordance with the present invention are clear. A BHA used in accordance with the present invention provides the ability to conduct both abrasive perforating and cleanout with a single BHA. Furthermore, a BHA usable in accordance with the present invention could still include a DFCV 12 where required or desired.

Figure 10:
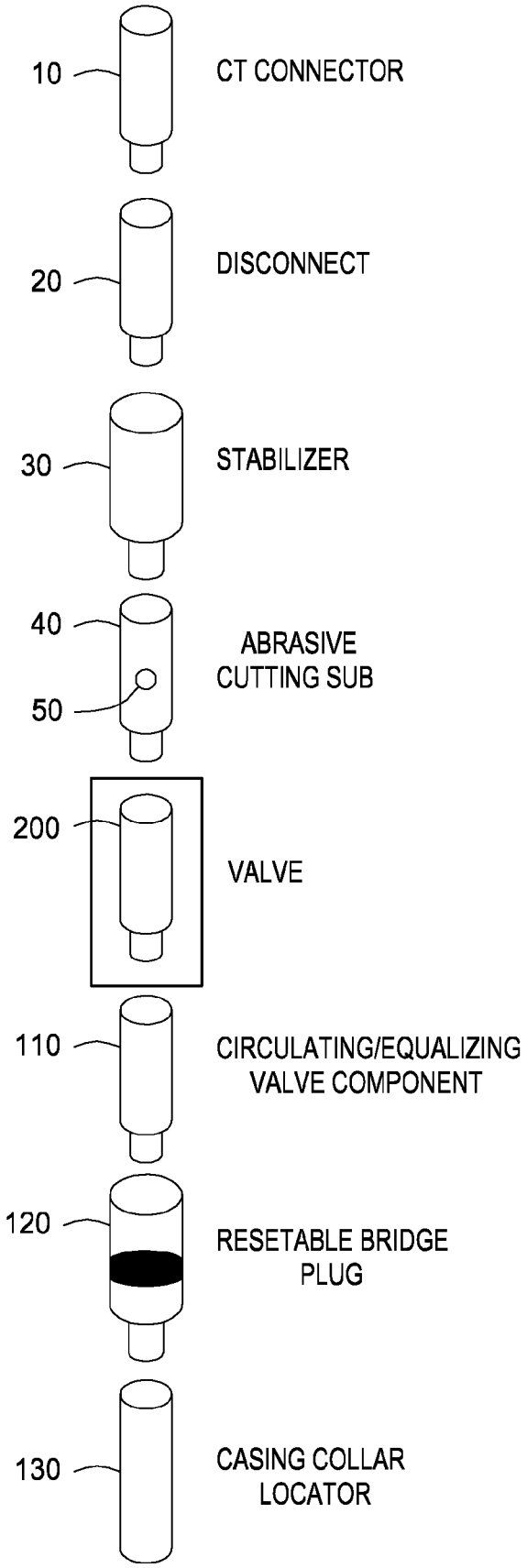
FIG. 10. illustrates a multistage frac system bottom hole assembly in accordance with an embodiment of the present invention with the jetting nozzle(s) in a separate component of the BHA than a multi-cycle open/close valve.
Figure 11:
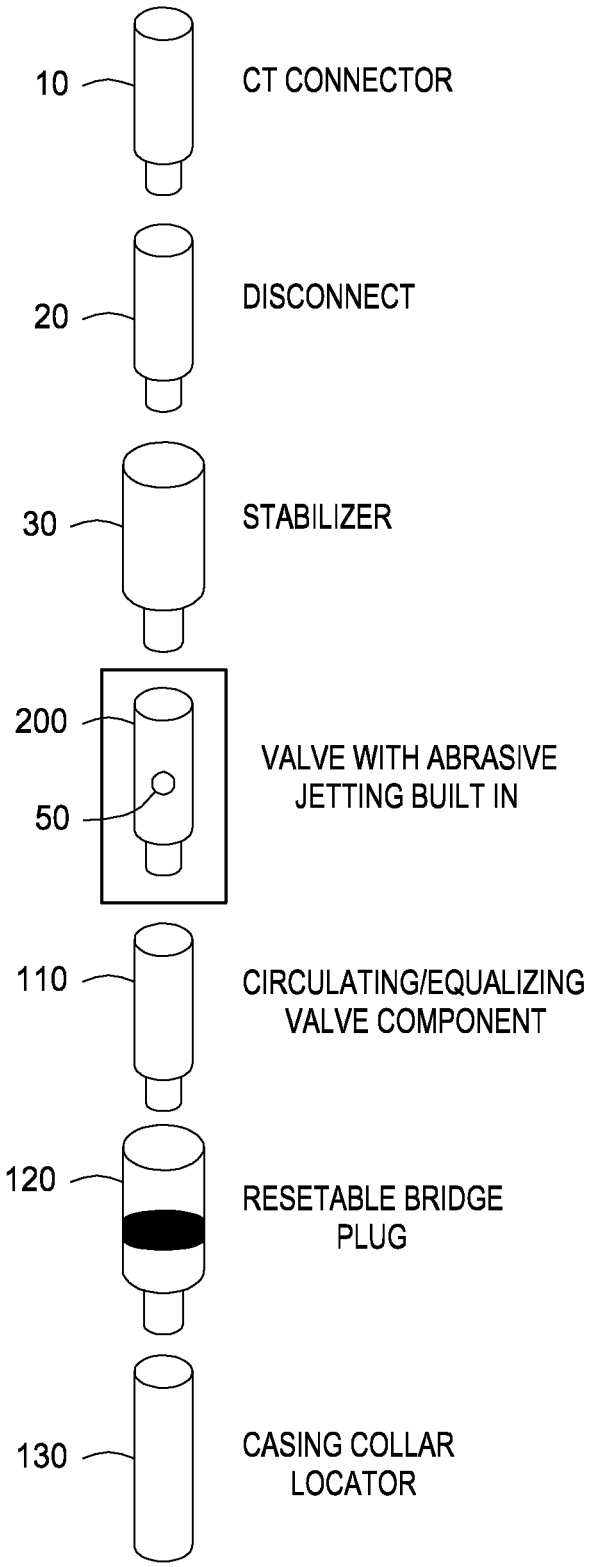
FIG. 11. illustrates a multistage frac system bottom hole assembly in accordance with an embodiment of the present invention with the jetting nozzle(s) included in a multi-cycle open/close valve.
Figure 12A:
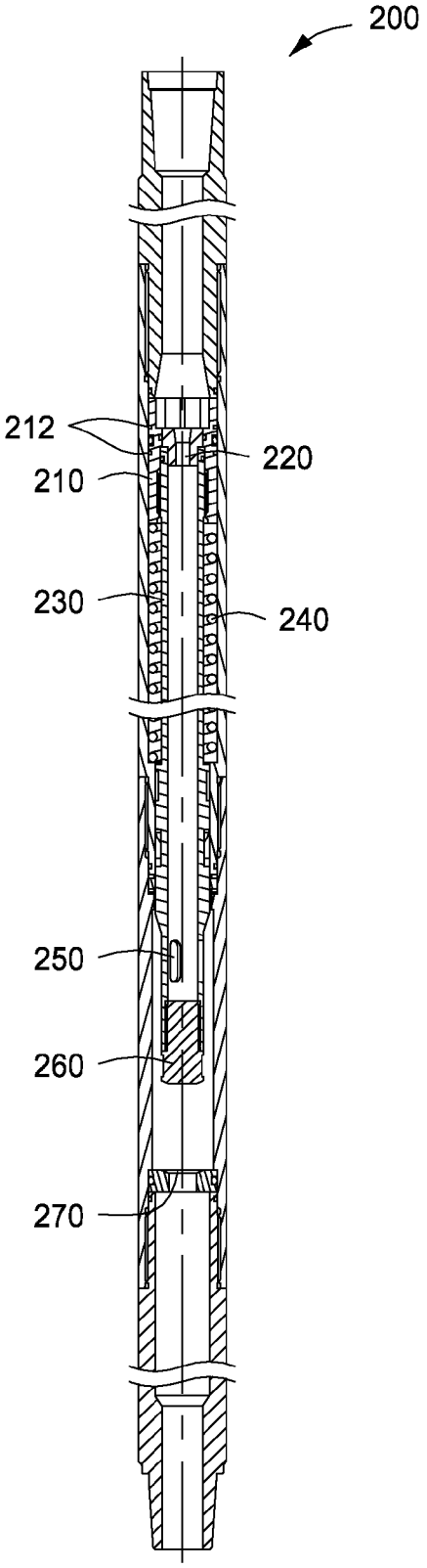
FIGS. 12A and 12B. illustrate examples of a multi-cycle open/close valve (MCOCV) in accordance with an embodiment of the present invention in a flow-through/cleanout mode below a triggering rate.
Figure 12B:
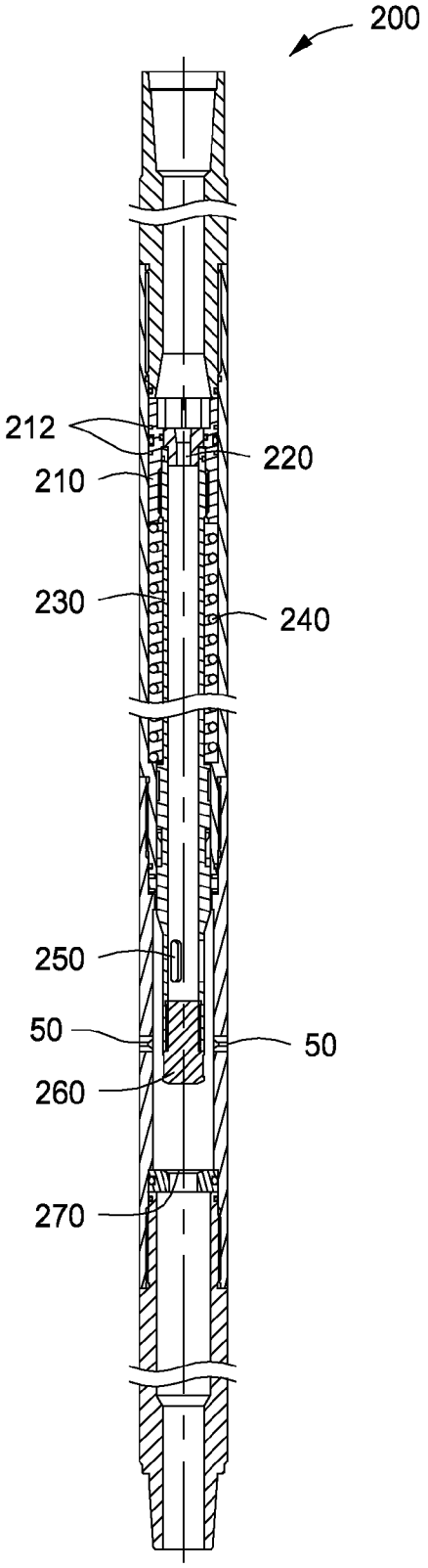
Figure 13A:
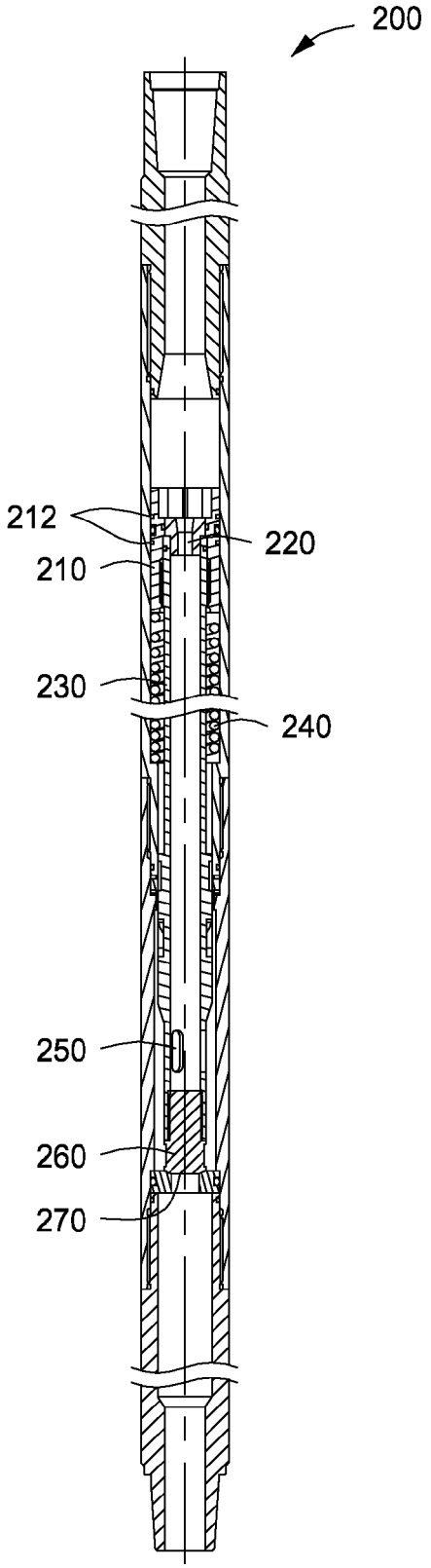
FIGS. 13A and 13B. illustrate examples of a MCOCV in accordance with an embodiment of the present invention in a closed/abrasive perforating mode.
Figure 13B:
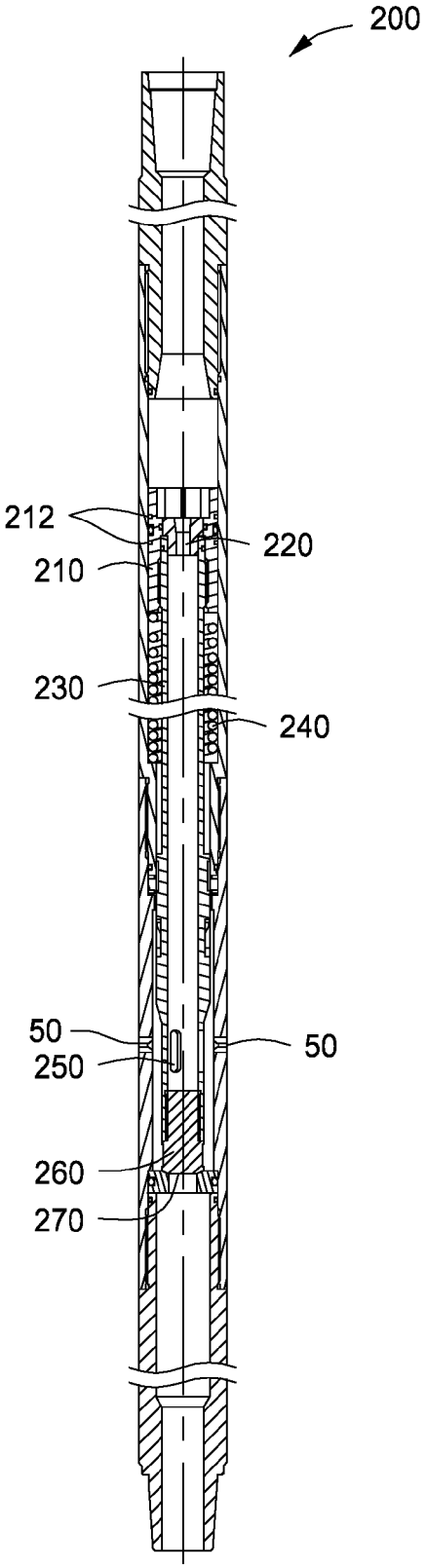
Figure 14A:
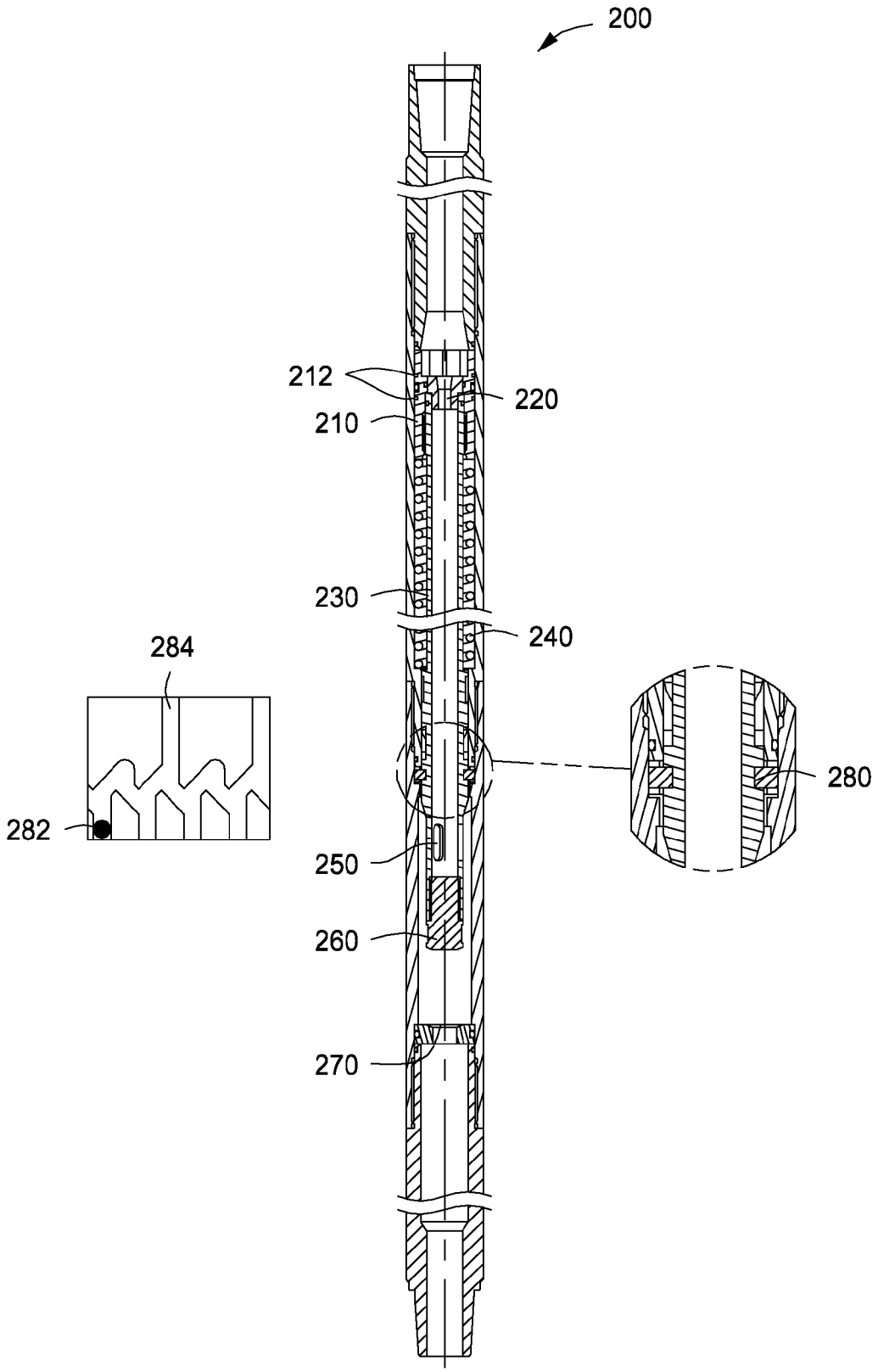
FIGS. 14A and 14B. illustrate examples of a MCOCV with a J-slot in accordance with another embodiment of the present invention in a flow-through/cleanout mode below a triggering rate.
Figure 14B:
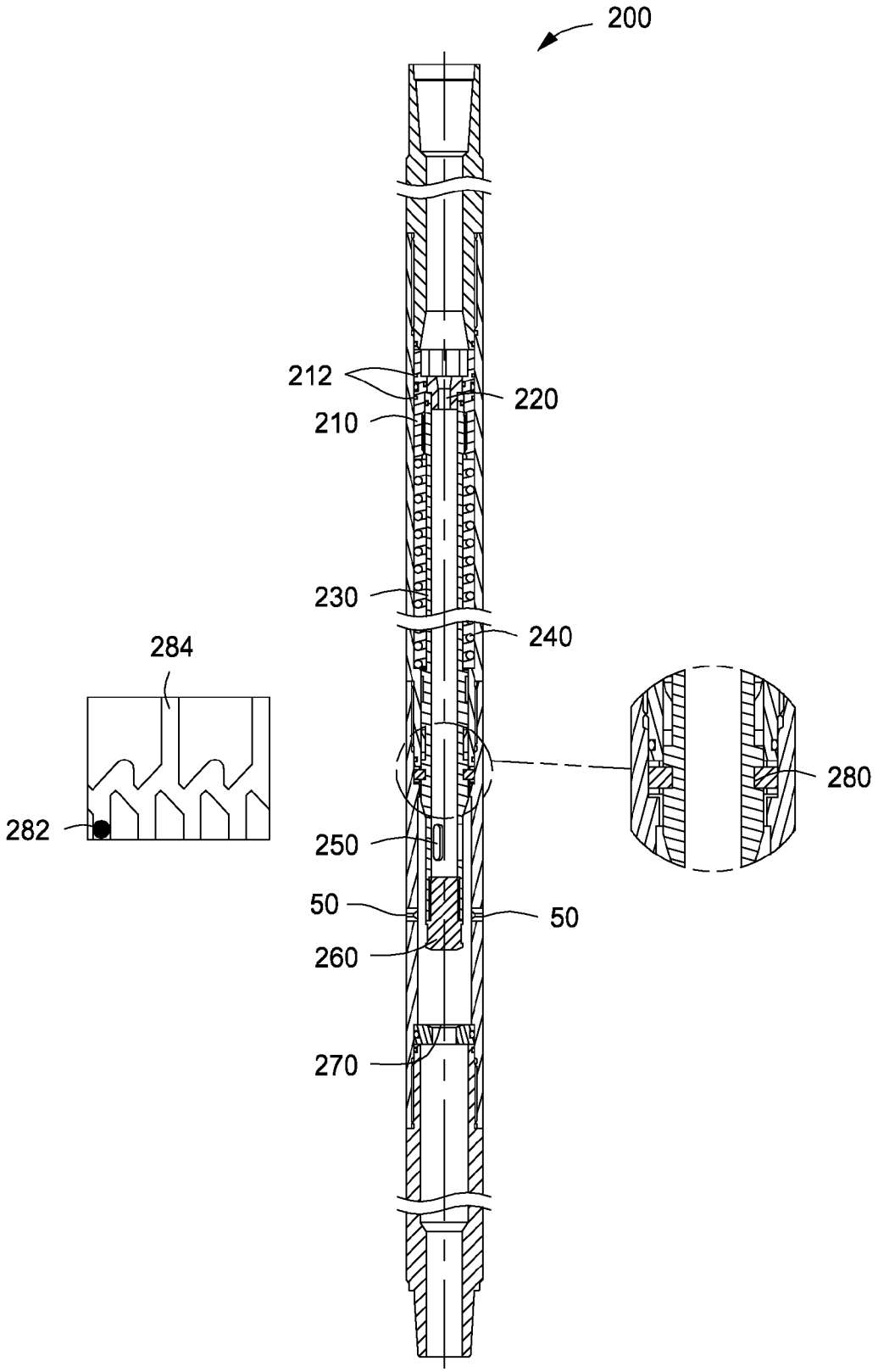

FIG. 10 illustrates a multistage frac system bottom hole assembly in accordance with an embodiment of the present invention with the jetting nozzle(s) in a separate component of the BHA than a multi-cycle open/close valve. Similarly, FIG. 11 illustrates a multistage frac system bottom hole assembly in accordance with an embodiment of the present invention with the jetting nozzle(s) included in a multi-cycle open/close valve.

As compared to the prior art methods and systems of FIG. 5, the present method and system provides the ability to open up isolation to larger ports in the BHA other than the abrasive perforating nozzle(s) when abrasive perforating isn't being conducted by manipulation from surface to enable higher pump rates for forward circulation as a contingency to remove sand. An additional advantage to the increased rate the ports would allow is that they could be placed closer to the top of the bridge plug for better sand removal from that area. This manipulation could be done using a flowrate controlled MCOCV like in the other cases or because with these two systems the BHA is mechanically attached to the wellbore when the high rate circulation would be required the isolating element between the abrasive perforating configuration and the less restrictive flow ports could be controlled mechanically instead.

A MCOCV 200 used in accordance with the present invention may be selected based on the desired abrasive perforating rate, desired cleanout rate, the CT, BHA and/or wellbore parameters and/or health, safety and environmental risks. For example, the flowrate capacity of the CT and/or the size and number of jetting nozzle(s) 50 to be used may be the basis of selecting the MCOCV 200 triggering rate. The back pressure of the BHA components below the MCOCV 200 may also be a factor for selecting the MCOCV 200. For a particular MCOCV 200 that is moveable based on one first flow rate and one second flow rate, for example, it may be required to select the MCOCV 200 based on the first flow rate being greater than the desired cleanout rate and lower than the desired abrasive perforating rate. In a particular illustrative example, where the desired abrasive perforating rate is 5 barrels per minute (bpm) and the desired cleanout rate is 4 bpm, the first flow rate for moving the MCOCV from open to closed position may be 4.5 bpm (as the rate down the CT).

Examples of an MCOCV 200 in accordance with embodiments of the present invention are illustrated in FIGS. 12A and 12B and FIGS. 13A and 13B. This MCOCV 200 may include a piston 210 movable between a higher position and a lower position. A piston o-ring may be disposed around the piston 210 to prevent pressure communication between the area above the piston and below the piston. Scrapers 212 may be placed on the piston 210 on either side of the piston o-ring to clear debris from the o-ring path while the piston 210 strokes. An orifice retainer may be fixedly disposed in the piston for holding an orifice 220 in place that defines an aperture permitting flow down that portion of the BHA. An orifice o-ring may be disposed around the orifice 220 to prevent pressure communication between the area above the orifice 220 and below the orifice 220 when flow is passing through the orifice 220. The aperture size of the orifice 220 may define the triggering rate and the orifice 220 may be selected based on its aperture size for configuring the triggering rate of the MCOCV. The aperture in the orifice 220 may be disposed along a surface of the piston such that flow through the orifice 220 may exert a pressure against this surface resulting in a force. One or more biasing elements, such as springs 240, may bias the piston to its higher position.

A mandrel 230 may be fixedly secured to the piston 210 and extending downward therefrom. The mandrel 230 may be a tube permitting flow therethrough to the lower section of the tool where it may have flow ports 250 to allow the fluid to exit. The lower tip of the mandrel 230 may be closed by a plunger 260 used to form a seal in a seat 270 when the piston 210 is in its lower position. Thus, when the pressure generated by the flow through the orifice 220 is not sufficient to move the piston 210 from its higher position to its lower position, the plunger 260 may be separated from the seat 270 to enable flow to the portion of the BHA below. When the pressure generated by the flow through the orifice 220 is sufficient to move the piston to its lower position, the plunger 260 may be urged against the seat 270 to seal the seat 270 and prevent flow through the flow path of the seat.

Another MCOCV 200 usable in accordance with the present invention may be selected based on a triggering rate that corresponds to the required incident flow rate to create a differential pressure to overcome the force of a biasing element in the MCOCV 200 so that the piston 210 will attempt to move down creating a seal inside resulting in the isolation of the flow. A J-slot 280 (or other sequencing technique) may be provided to restrict the movement of the piston 210 to fully stroke and seal off the flow on an alternating sequence of flows passing up through the triggering rate. For this reason the MCOCV 200 can remain open at flow rates above the triggering rate on an alternating sequence for higher cleanout rates.

Figure 15A:
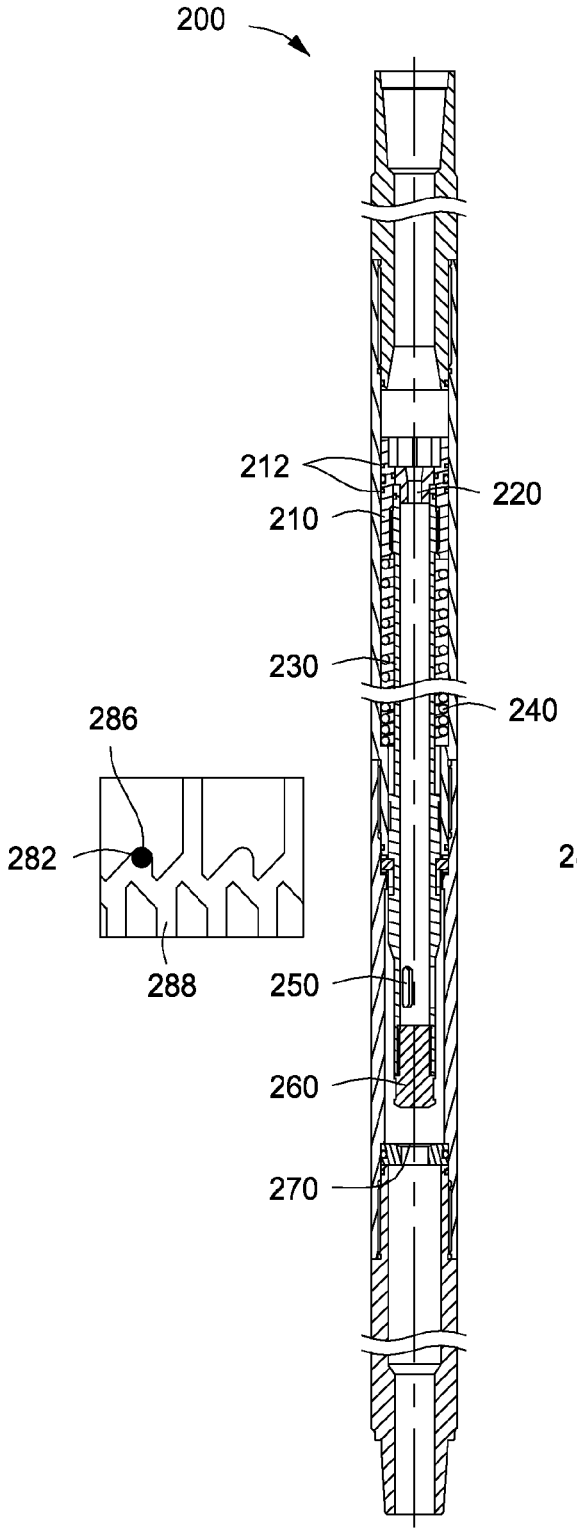
FIGS. 15A and 15B. illustrate examples of a MCOCV with a J-slot in accordance with another embodiment of the present invention in a flow-through/cleanout mode above a triggering rate (internal movement restricted by J-slot mechanism).
Figure 15B:
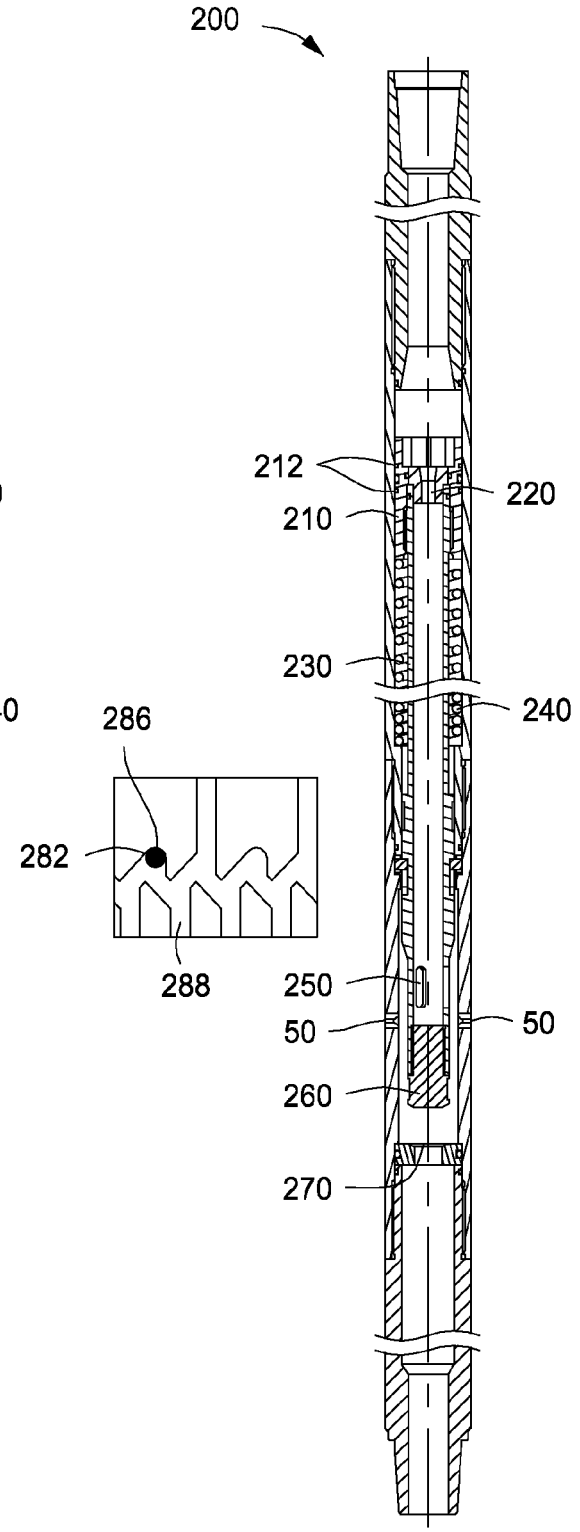
Figure 16A:
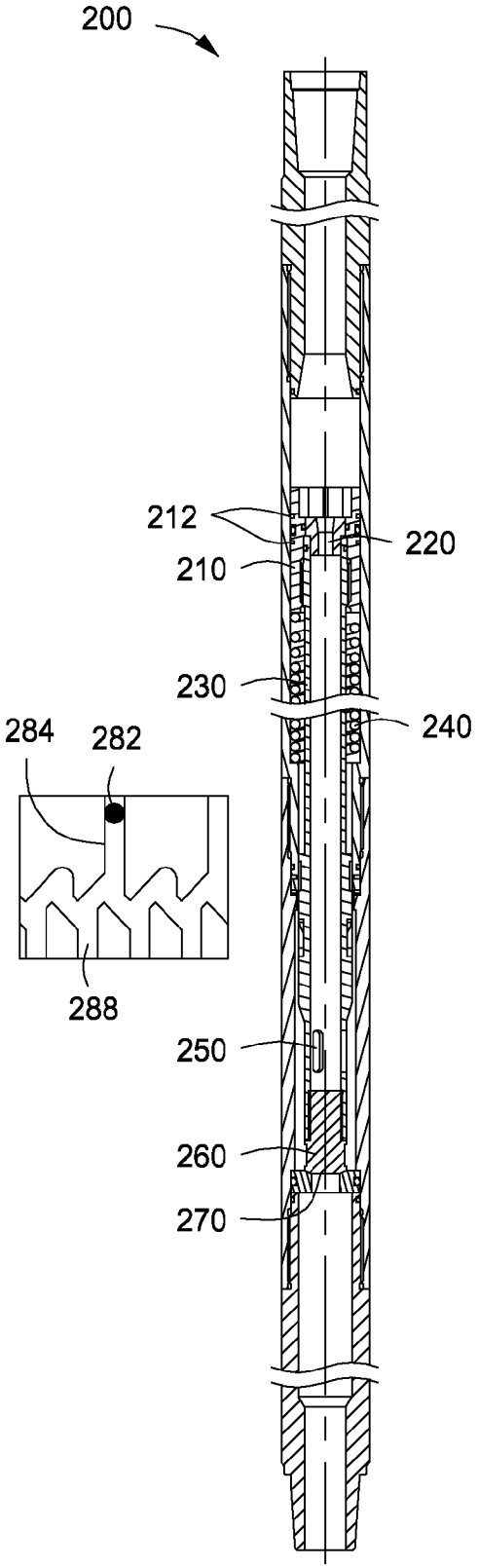
FIGS. 16A and 16B. illustrate examples of a MCOCV with a J-slot in accordance with another embodiment of the present invention in a closed/abrasive perforating mode.
Figure 16B:
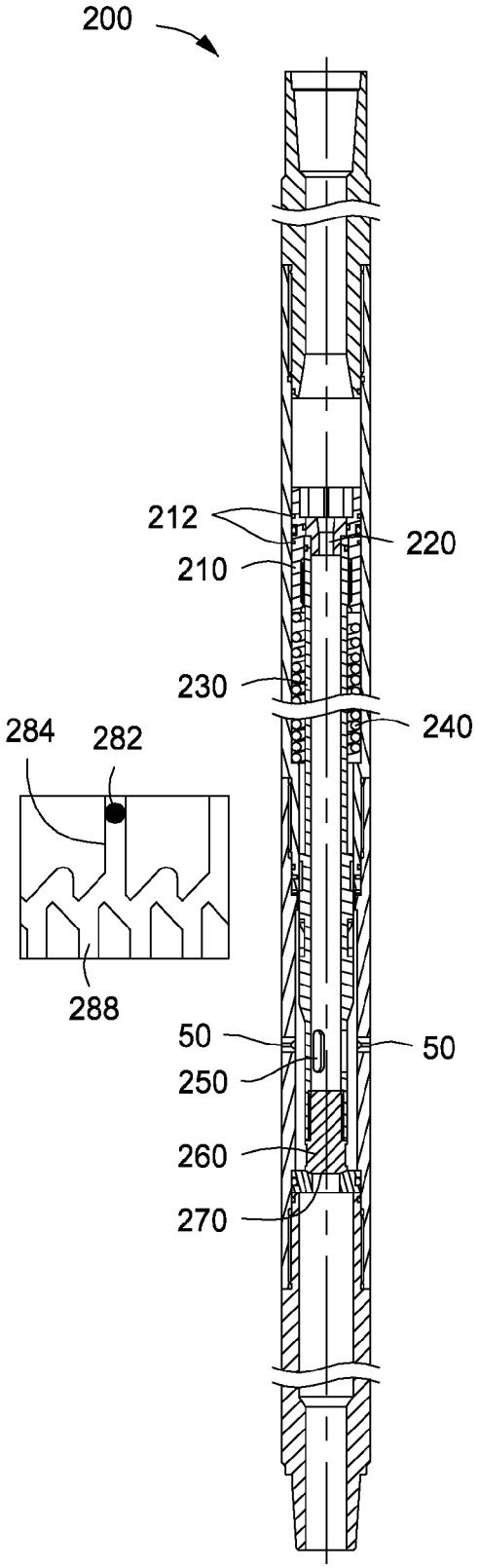

Examples of such an MCOCV 200 in accordance with the present invention are illustrated in FIGS. 14A and 14B, FIGS. 15A and 15B, and FIGS. 16A and 16B. The MCOCV 200 may include a piston 210 movable between a higher position and a lower position. A piston o-ring may be disposed around the piston 210 to prevent pressure communication between the area above the piston and below the piston. Scrapers 212 may be placed on the piston 210 on either side of the piston o-ring to clear debris from the o-ring path while the piston 210 strokes. An orifice retainer may be fixedly disposed in the piston for holding an orifice 220 in place that defines an aperture permitting flow down that portion of the BHA. An orifice o-ring may be disposed around the orifice 220 to prevent pressure communication between the area above the orifice 220 and below the orifice 220 when flow is passing through the orifice 220. The aperture size of the orifice 220 may define the triggering rate and the orifice 220 may be selected based on its aperture size for configuring the triggering rate of the MCOCV 200. The aperture in the orifice 220 may be disposed along a surface of the piston 210 such that flow through the orifice 220 may exert a pressure against this surface resulting in a force. One or more biasing elements, such as springs 240, may bias the piston 210 to its higher position. A J-slot 280 profile may be present on a movable component of the internals of the MCOCV 200 (the mandrel 230 for example) and a corresponding pin or pins 282 that cooperate with the J-slot 280 profile groove (284, 286, 288) may be present on the inside of the housing of the MCOCV 200 or a collar, which may be free to rotate, but may not move length-wise inside of the MCOCV 200. The cooperation of the pin or pins 282 and the J-slot profile groove (284, 286, 288) may restrict the travel of the piston 210 and connected MCOCV 200 internals on alternating times the flow rate increases past the triggering rate. (An illustration of this is shown in FIGS. 15A and 15B.)

A mandrel 230 may be fixedly secured to the piston 210 and extending downward therefrom. The mandrel 230 may be a tube permitting flow therethrough to the lower section of the mandrel where it may have flow ports 250 to allow the fluid to exit. The lower tip of the mandrel 230 may be closed by a plunger 260 and used to seal in a seat 270 when the piston 210 is in its lower position. Thus, when the pressure generated by the flow through the orifice 220 is not sufficient to move the piston 210 from its higher position to its lower position, or the J-slot 280 is preventing the travel of the piston 210 when the pressure generated by the flow through the orifice 220 is sufficient, the plunger 260 may be separated from the seat 270 to enable flow to the portion of the BHA below. When the pressure generated by the flow through the orifice 220 is sufficient to move the piston 210 to its lower position and the J-slot 280 is not restricting the travel of the piston 210 and connected MCOCV 200 internals, the plunger 260 may be urged against the seat 270 to seal the seat 270 and prevent flow to the portion of the BHA below.

Optimally, a MCOCV 200 used in accordance with the present invention is pressure balanced while in the open position so that hydrostatic and back pressure from the portion of the BHA below does not affect it. This will cause the MCOCV 200 to solely rely on the flow rate that passes through it to create a pressure differential internally, whether it be through an orifice, needle and seat, or another method, and force the MCOCV 200 to close. Once the valve has closed a differential area for the higher pressure above may be created, such that the pressure differential between the portion of the BHA above and the portion of the BHA below, rather than only the flowrate, keeps the MCOCV 200 closed. The pressure in the portion of the BHA above the MCOCV 200 may drastically increase (to a differential pressure of approximately 2000 psi when abrasive perforating) because the majority of the total flowrate down the CT, which was previously passing through the MCOCV 200 and exiting the portion of the BHA below will now be directed though the small, high pressure jetting nozzle(s) 50 above. For this reason, and that the o-ring friction is now acting in the opposite direction, the MCOCV 200 will not open until the flowrate down the CT is lowered to a lower amount than was required to close the valve. At this point, the biasing element 240 urges the piston upward until it overcomes the friction caused by the o-ring and the pressure created by the flow to open the MCOCV 200. As the piston 210 begins to move upward, opening the seal between the plunger 260 and the seat 270, it begins to allow residual pressure from above to dissipate, by exiting through the end of the lower section of the BHA. This makes it easier for the force of the spring 240 to return the MCOCV 200 to the open position, resulting in a quick, crisp transition. In the above example, this rate may be 1 bpm resulting in back pressure of 200 psi through the jetting nozzle(s). If the jetting nozzle(s) 50 is/are above the piston of the MCOCV 200, whether incorporated into the MCOCV 200 component or in a separate component above in the BHA, differential pressure inside the MCOCV 200 may keep the MCOCV 200 closed, as there would be no flow and resulting pressure drop through the piston orifice 220. If the jetting nozzle(s) 50 is/are incorporated into the MCOCV 200 component below the piston but above the flow-through isolation seal, a differential pressure across the seal may aid in maintaining closure, but force to keep the MCOCV 200 closed may also be generated by the continuation of flow through the piston orifice 220.

The present invention can be practised where the cleanout rate is nearly as high, equally high or higher than the abrasive perforating rate by including a J-slot 280 in MCOCV 200, while allowing the MCOCV 200 to be closed at higher rate and open at lower rate. The J-slot 280 may be a groove disposed around a movable component of the internals of the MCOCV 200 (the mandrel 230 for example). One or more pins 282 may be fixedly disposed (fixed relative to the longitudinal direction) inside the MCOCV 200 housing to restrict movement by means of the J-slot groove (284, 286, 288). When the piston 210 and internals move longitudinally, the pin 282 may cause the piston 210 and internals to ratchet, or rotate, in a circular path. Also, the component housing the J-slot pin or pins 282 may ratchet, or rotate, in a circular path. The J-slot groove (284, 286, 288) may be configured so that every second (or third, fourth, etc.) time the flow rate is brought above the triggering rate the piston and connected internal's travel is restricted, so that plunger 260 cannot seal against the seat 270 and the MCOCV 200 will remain open for cleanout at rates above the triggering rate. On other cycles the J-slot groove (284, 286, 288) may allow the piston 210 and internals to travel further so that the plunger 260 seals against the seat 270 and the MCOCV 200 to close for abrasive perforating.

In this implementation the rate during a cleanout could exceed the rate during abrasive perforating without shifting the MCOCV 200. Although the J-slot 280 would only be required in the situation where the cleanout rate equals or exceeds the perforating rate, it may be preferable to always have it present and set the triggering rate of the MCOCV 200 lower than it would otherwise be to allow a larger margin for it to move before reaching the abrasive perforating rate or to have it present with the same triggering rate and allow for a potential higher cleanout rate.

When the J-slot 280 is being used, the MCOCV 200 may open when the rate is lowered past the flow rate at which the pressure generated by the flow exiting the jetting nozzle(s) acting on the higher pressure side of the internal seal can be overcome by the spring to enable cleanout. This flowrate will be lower than the triggering rate to close the MCOCV 200. Once the flow rate is further lowered to a particular rate the MCOCV 200 will again open and fluid will be able to exit out to the components of the BHA below. The advantage having the MCOCV 200 isolate the flow to the lower section of the BHA on a sequence instead of every time is that higher flowrates can be used for the cleanout, whereas previously they would normally be limited to a rate less than which is used for the abrasive perforating portion.

A MCOCV 200 without the J-slot 280 could also be used with the cleanout rate being higher than the abrasive perforating rate. In this case the MCOCV 200 would normally be closed and flow rate to the BHA would be used to open it.

A BHA in accordance with the present invention may also include a ball seat disposed between the jetting nozzle(s) (50) and the internal flow-through preventing seal of the MCOCV 200 as a contingency measure. The ball seat could be a separate component above the MCOCV 200 when the jetting nozzle(s) 50 are held in a separate component of the BHA or included in the MCOCV 200 when the jetting nozzle(s) 50 are held in the same component as the MCOCV 200 or held in a separate component of the BHA. The ball seat could also be incorporated into the piston orifice 220 to seal flow at the piston, preventing flow therethrough when the jetting nozzle(s) 50 is/are located above the piston 210 on the MCOCV 200, whether the jetting nozzle(s) 50 is/are held in the same component as the MCOCV 200 or a separate component above the MCOCV 200.

A ball seat retainer could be provided to enable changing out of the ball seat based on the particular application of the BHA. The ball seat retainer would hold the ball seat in place in this case. An o-ring may be disposed around the ball seat to prevent pressure communication between the area above and below the ball seat.

Figure 3:
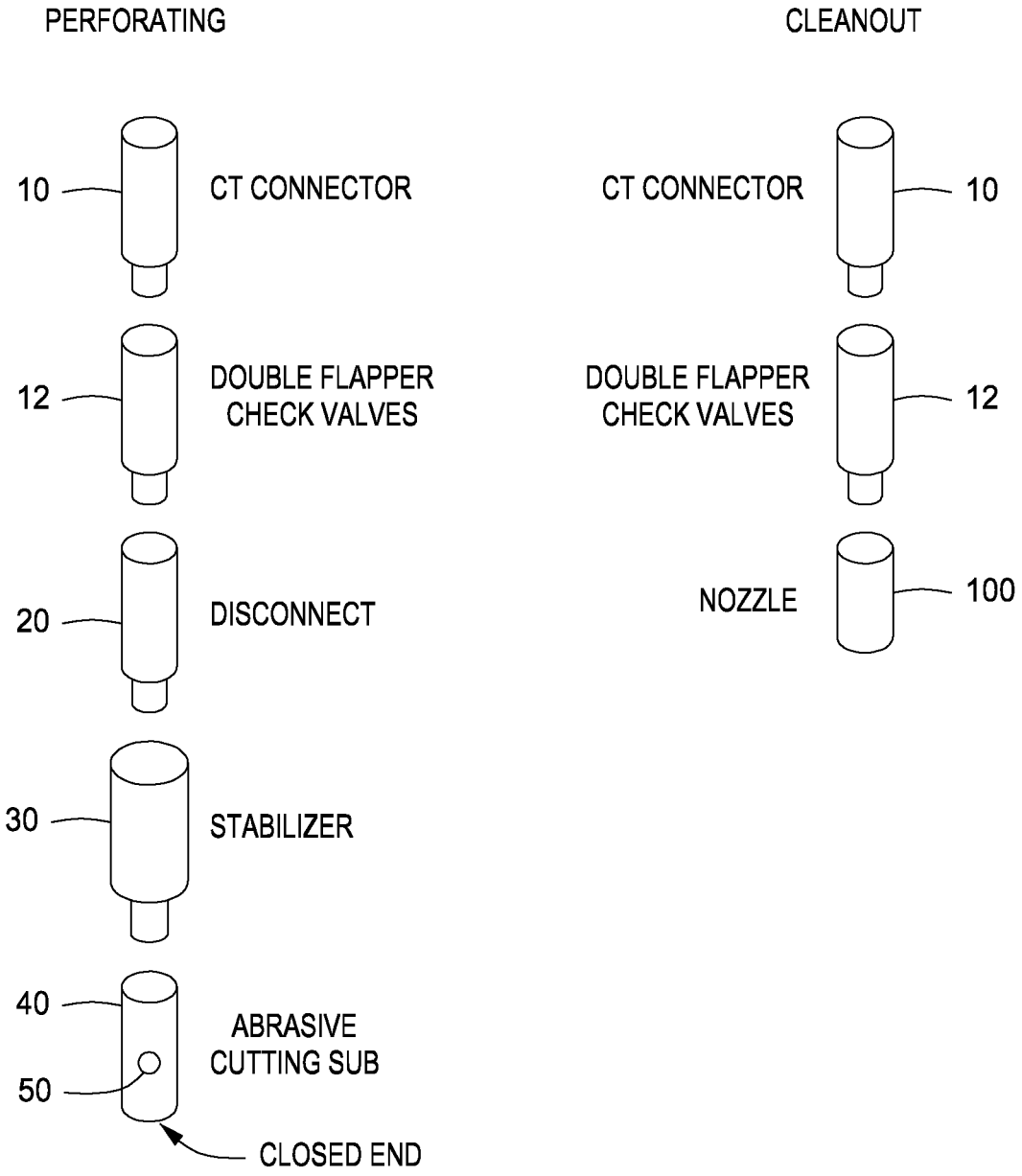
FIG. 3 (PRIOR ART)
FIG. 3 illustrates an abrasive perforating bottom hole assembly using a double flapper check valve of the prior art and a cleanout bottom hole assembly using a double flapper check valve of the prior art.

The ball seat may be selected based on the size of ball to be used, which may be based on the flow rate and the ball size that will pass through the BHA from the surface to the ball seat. This ball seat could serve as a backup in the event the MCOCV 200 does not close, to isolate flow from the lower portion of the BHA when attempting to abrasive perforate. If this event occurs, a ball of corresponding size, which has been selected to pass through the components of the BHA above the ball seat, can be circulated down from the surface and seated between the jetting nozzle(s) and the MCOCV 200 sealing element, thus isolating flow from exiting the bottom of the BHA, as in cleanout. This prevents failure of the MCOCV 200 to hinder operation of the BHA beyond conventional methods. The BHA, in this case, could be used as in the prior art where a reverse flow is used to remove the ball if no DFCV 12 is present as in FIG. 4. If a DFCV 12 was present it would now function the same as the abrasive perforating BHA in FIG. 3.

In operation, once the BHA is placed at the desired depth, a fluid pump operable with the BHA can be brought to the triggering rate to close the MCOCV 200. At this point (or on sequencing using the J-slot) the MCOCV 200 will close and the flow will exit completely through the jetting nozzle(s) above the section in the MCOCV 200 that isolates flow to the lower section of the BHA. A pressure signal linked to the fluid pump will clearly show when the MCOCV 200 has closed since the pressure may increase greatly at this time. Upon completion of the abrasive perforating portion the rate can be lowered to a sufficient rate to open the MCOCV 200. A person skilled in the art will understand, based on the pressure signal, when the MCOCV 200 has opened. Alternatively, or additionally, to confirm the transition the rate can be increased to a point below the triggering rate, yet high enough so a large difference can be seen on the circulation pressure if the flow was exiting completely through the jetting nozzle(s) or if the majority is passing through the MCOCV 200. Once this transition is completed the BHA is now configured for a cleanout, if required.

If the jetting nozzle(s) 50 would be included in the MCOCV 200 component, they could be included either above or below the piston 210. The piston orifice 220 could be sized accordingly when the jetting nozzle(s) 50 would be included below the piston 210 to allow for the appropriate triggering rate.

Thus, in an aspect, there is provided a method of performing abrasive perforating and cleanout of a wellbore using a bottom hole assembly (BHA) with one direction of flow, comprising: providing a multicycle open/close valve (MCOCV) responsive to a plurality of flow rates in the BHA; at one or more first flow rates, configuring the MCOCV to operate in a first operating mode to abrasive perforate the wellbore; and at one or more second flow rates, configuring the MCOCV to operate in a second operating mode to cleanout the wellbore.

In an embodiment, the method further comprises: providing in the MCOCV a sequencing mechanism responsive to a sequence of flow rates; and in response to a sequence of flow rates, configuring the MCOCV to cycle through operating modes to abrasive perforate the wellbore or to cleanout the wellbore.

In another embodiment, the method further comprises providing a J-slot sequencing mechanism as the sequencing mechanism in the MCOCV.

In another embodiment, the method further comprises setting the one or more first flow rates for configuring the MCOCV to operate in a closed valve mode to abrasive perforate the wellbore to be higher than the one or more second flow rates for configuring the MCOCV to operate in an open valve mode to cleanout the wellbore.

In another embodiment, the method further comprises setting one or more third flow rates for configuring the MCOCV to return from the closed valve mode to the open valve mode.

In another embodiment, the method further comprises setting the one or more first flow rates for configuring the MCOCV to operate in a closed valve mode to abrasive perforate the wellbore to be lower than the one or more second flow rates for configuring the MCOCV to operate in an open valve mode to cleanout the wellbore.

In another embodiment, the method further comprises setting one or more third flow rates for configuring the MCOCV to return from the open valve mode to the closed valve mode.

In another embodiment, the method further comprises placing the MCOCV between jetting nozzle(s) and a bottom of the BHA.

In another embodiment, the method further comprises incorporating the jetting nozzle(s) in an MCOCV component.

In another embodiment, the method further comprises providing a double flapper check valve (DFCV) in the BHA.

In another aspect, there is provide an apparatus for performing abrasive perforating and cleanout of a wellbore using a bottom hole assembly (BHA) with one direction of flow, comprising: a multicycle open/close valve (MCOCV)

responsive to a plurality of flow rates and adapted to be placed in the BHA, the MCOCV configured to: operate in a first operating mode to abrasive perforate the wellbore at one or more first flow rates; and operate in a second operating mode to cleanout the wellbore at one or more second flow rates; whereby, in use, the MCOCV is controllable by the flow rates to either perform abrasive perforating of the wellbore or to cleanout the wellbore.

In an embodiment, the apparatus further comprises a sequencing mechanism responsive to a sequence of flow rates, the sequencing mechanism configured to cycle the MCOCV through operating modes to abrasive perforate the wellbore or to cleanout the wellbore.

In another embodiment, the sequencing mechanism is a J-slot sequencing mechanism provided in the MCOCV.

In another embodiment, the MCOCV is configured to operate in a closed valve mode to abrasive perforate the wellbore at one or more first flow rates set higher than the one or more second flow rates for configuring the MCOCV to operate in an open valve mode to cleanout the wellbore.

In another embodiment, the MCOCV is configured to return to the open valve mode at one or more third flow rates.

In another embodiment, the MCOCV is placed between jetting nozzle(s) and a bottom of the BHA.

In another embodiment, the MCOCV integrates jetting nozzle(s) in an MCOCV component.

In another embodiment, the apparatus further comprises a double flapper check valve (DFCV) placed in the BHA.

Having described several embodiments of the invention in detail, various modifications and improvements will readily occur to those skilled in the art. Accordingly, the foregoing description is by way of example only, and is not intended as limiting, and the scope of the invention is defined by the following claims.

The invention claimed is:

1. A method of completing a wellbore using a bottom hole assembly requiring only one direction of flow, the wellbore having been lined with a string of production casing along a subsurface formation, and the method comprising:

running a bottom hole assembly into the wellbore on a lower end of a string of coiled tubing, the bottom hole assembly comprising:

a tubular housing providing an elongated bore through which fluids may flow, the tubular housing having one or more jetting nozzles disposed therein, a piston disposed at an upstream end of the housing, the piston forming a pressure shoulder downstream from the coiled tubing and having at least one orifice delivering fluids from an internal bore of the coiled tubing to the elongated bore of the housing, a tubular mandrel slidably positioned within the housing, the mandrel having a proximal end connected to the piston, and at least one flow port along a body of the mandrel, a plunger disposed along the mandrel, and providing a seal for the distal end of the mandrel, and a seat residing at a distal end of the tubular housing dimensioned to sealingly receive the plunger when the piston and connected mandrel slide from a first open valve position to a second closed valve position;

locating the bottom hole assembly at a selected zone of interest in the subsurface formation;

injecting fluids down the coiled tubing and into the bore of the tubular housing at a first flow rate, thereby causing the fluids to flow through the at least one orifice in the piston, through the at least one flow port in the mandrel, around the distal end of the mandrel, through the seat, and back up an annular region defined between the bottom hole assembly and the surrounding production casing;

further injecting a fluid down the coiled tubing and into the bore of the tubular housing at a second flow rates that is higher than the first flow rate, thereby increasing a hydraulic force acting on the pressure shoulder of the piston and causing the mandrel to slide from its open position to its closed position wherein the plunger is landed on the seat, thereby forcing the injected fluid to flow through the nozzles in the tubular housing; and injecting a jetting fluid through the nozzles in the tubular housing, thereby jetting one or more perforations through the production casing at the selected zone of interest along the wellbore.

2. The method of claim 1, wherein the bottom hole assembly further comprises:

a spring residing in an annular space between the mandrel and a portion of the tubular housing, the spring being pre-loaded in compression to bias the mandrel and connected plunger in the open valve position; and a sequencing mechanism responsive to a sequence of flow rates applied above the piston;

wherein the sequencing mechanism is configured to cycle the mandrel between its open valve position wherein the bottom hole assembly is in a cleanout mode, and its closed valve position wherein the bottom hole assembly is in a perforating mode.

3. The method of claim 2, wherein:

the sequencing mechanism is a J-slot mechanism comprising a J-slot profile located along the mandrel; and the J-slot mechanism cooperates with at least one pin disposed along the tubular housing, wherein the pin is fixed from axial movement and rides in slots of the J-slot profile of the mandrel to restrict axial movement of the mandrel on alternating downward strokes.

4. The method of claim 3, wherein the step of injecting fluid at the first flow rates:

is conducted using an abrasive jetting fluid, a cleanout fluid, or combinations thereof;

permits fluid communication with the nozzles; and maintains the mandrel in its cleanout mode at least until the second higher flow rate is reached; and wherein injecting fluid when the plunger is landed on the seat causes the fluid to flow through the at least one flow port in the mandrel and then exclusively through the nozzles for perforating.

5. The method of claim 4, further comprising:

after forming one or more perforations through the production casing, reducing the flow rate below the second flow rate, thereby allowing the mandrel to return from the closed valve position to the open valve position; and injecting a cleanout fluid through the seat and back up the annular region between the bottom hole assembly and the surrounding production casing, and to a surface.

6. The method of claim 5, wherein the J-slot mechanism cycles between four settings, comprising:

a first setting wherein the pin resides in a first slot that places the mandrel in a first open valve position in response to the biasing mechanical force exerted by the spring on the mandrel, a second setting wherein the pin moves higher in the first slot in response to the injection of fluids through the piston and into the bottom hole assembly at the second rate, or at any rate higher than the second rate, but wherein the mandrel is restrained from sliding from its open valve position to its closed valve position but is maintained at a second open valve position;

a third setting wherein the pin resides in a second slot that again places the mandrel in its first open valve position in response to the biasing mechanical force exerted by the spring on the mandrel; and a fourth setting wherein the pin moves higher in the second slot in response to the injection of fluids through the piston and into the bottom hole assembly at the second rate, or at any rate higher than the second rate, and wherein the mandrel is allowed to slide from its open valve position to its closed valve position.

7. The method of claim 3, further comprising:

providing a re-settable bridge plug along the tubular housing downstream of the seat;

providing a casing collar locator as part of the bottom hole assembly; or both.

8. The method of claim 2, wherein the step of injecting fluid at the first flow rate:

is conducted using an abrasive jetting fluid, a cleanout fluid, or combinations thereof;

permits fluid communication with the nozzles; and maintains the mandrel in its cleanout mode at least until the second higher flow rate is reached; and wherein injecting fluid when the plunger is landed on the seat causes the fluid to flow through the at least one flow port in the mandrel and then exclusively through the nozzles for perforating.

9. The method of claim 8, further comprising:

after forming one or more perforations through the production casing, reducing the flow rate below the second flow rate, thereby allowing the mandrel to return from the closed valve position to the open valve position; and injecting a cleanout fluid through the seat and back up the annular region between the bottom hole assembly and the surrounding production casing, and to a surface, for wellbore cleanout.

10. The method of claim 1, further comprising:

providing a double flapper check valve upstream of the piston.

11. The method of claim 1, further comprising:

adjusting an aperture size of the orifice associated with the piston, thereby accommodating flow rate variations associated with the open and closed valve positions arising from changes in mandrel dimensions.

12. A bottom hole assembly requiring only one direction of flow for completion of a wellbore, the wellbore having been lined with a string of production casing along a selected subsurface formation, comprising:

a tubular housing providing an elongated bore through which fluids may flow, the tubular housing having one or more jetting nozzles disposed therein, a piston disposed at an upstream end of the housing, the piston forming a pressure shoulder and having at least one orifice configured to deliver fluids from a wellbore conveyance tubing to the elongated bore of the housing, a tubular mandrel slidably positioned within the housing, the mandrel having a proximal end connected to the piston, and at least one flow port along a body of the mandrel, a plunger disposed along the mandrel, and providing a seal for the distal end of the mandrel, and a seat residing at a distal end of the tubular housing dimensioned to sealingly receive the plunger when the piston and connected mandrel slide from a first open valve position to a second closed valve position; and wherein the bottom hole assembly is configured to:

operate in a wellbore cleanout mode wherein fluids flow into the bore of the tubular housing at a first flow rate, thereby causing fluid to flow through the at least one orifice in the piston, through the at least one flow port in the mandrel, around the distal end of the mandrel, through the seat, and back up an annular region defined between the bottom hole assembly and a surrounding production casing within a wellbore; and operate in a perforating mode wherein a fluid flows into the bore of the tubular housing at a second flow rate that is higher than the first flow rate, thereby increasing a hydraulic force acting on the pressure shoulder of the piston and causing the mandrel to slide from its open valve position to its closed valve position wherein the plunger is landed on the seat, thereby forcing a jetting fluid to flow through the nozzles in the tubular housing, to enable forming one or more perforations through a surrounding string of production casing along the wellbore;

whereby, in use, the bottom hole assembly is controllable by flow rates to either perform perforating of production casing or to clean out the wellbore.

13. The bottom hole assembly of claim 12, further comprising:

a spring residing in an annular space between the mandrel and a portion of the tubular housing, the spring being pre-loaded in compression to bias the mandrel and connected plunger in the open valve position; and a sequencing mechanism responsive to a sequence of flow rates applied above the piston;

wherein the sequencing mechanism is configured to cycle the mandrel between its open valve position wherein the bottom hole assembly is in a cleanout mode, and its closed valve position wherein the bottom hole assembly is in a perforating mode.

14. The bottom hole assembly of claim 13, wherein:

the sequencing mechanism is a J-slot sequencing mechanism; and the J-slot mechanism cooperates with at least one pin disposed along the tubular housing configured to ride in slots along the J-slot mechanism to cycle between the open and closed valve positions.

15. The bottom hole assembly of claim 13, wherein the bottom hole assembly is configured such that:

operation of the assembly at both the first flow rate and the second flow rate permits fluid communication between the piston and the nozzles;

operation of the assembly at the first flow rate maintains the mandrel in its cleanout mode at least until the second higher flow rate is reached; and injection of fluid at the second flow rate when the plunger is landed on the seat injects the fluid through the at least one flow port in the mandrel en route to the nozzles.

16. The bottom hole assembly of claim 15, wherein the assembly is further configured to:

allow the mandrel to return from the closed valve position to the open valve position upon reducing the flow rate below the second flow rate.

17. The bottom hole assembly of claim 15, wherein the assembly is further configured to:

permit fluid communication with the nozzles; and maintain the bottom hole assembly in its cleanout mode at least until the second higher flow rate is reached.

18. The bottom hole assembly of claim 15, further comprising:

a re-settable bridge plug along the tubular housing downstream of the seat;

a casing collar locator; or both.

19. The bottom hole assembly of claim 15, wherein the J-slot mechanism is configured to cycle between four settings, comprising:

a first setting wherein the pin resides in a first slot that places the mandrel in a first open valve position in response to the biasing mechanical force exerted by the spring on the mandrel, a second setting wherein the pin moves higher in the first slot in response to the injection of fluids through the piston and into the bottom hole assembly at the second rate, or at any rate higher than the second rate, but wherein the mandrel is restrained from sliding from its open valve position to its closed valve position but is maintained at a second open valve position;

a third setting wherein the pin resides in a second slot that again places the mandrel in its first open valve position in response to the biasing mechanical force exerted by the spring on the mandrel; and a fourth setting wherein the pin moves higher in the second slot in response to the injection of fluids through the piston and into the bottom hole assembly at the second rate, or at any rate higher than the second rate, and wherein the mandrel is allowed to slide from its open valve position to its closed valve position.

20. The bottom hole assembly of claim 12, further comprising:

a double flapper check valve upstream of the piston.

21. A method of jet-perforating a string of production casing in a wellbore, the method comprising:

(a) placing a bottom hole assembly in the wellbore along a string of production casing, the bottom hole assembly comprising:

a tubular housing providing an elongated bore through which fluids may flow, the tubular housing having one or more jetting nozzles disposed therein, a piston disposed at an upstream end of the housing, the piston forming a pressure shoulder downstream from the coiled tubing and having at least one orifice delivering fluids from a conveyance string to the elongated bore of the housing, a tubular mandrel slidably positioned within the housing, the mandrel having a proximal end connected to the piston, and at least one flow port along a body of the mandrel, a plunger disposed along the mandrel, and providing a seal for the distal end of the mandrel in response to flow rates in the conveyance string above the piston, and a seat residing at a distal end of the tubular housing dimensioned to sealingly receive the plunger when the piston and connected mandrel slide from a first wellbore cleanout position to a second perforating position;

(b) configuring the bottom hole assembly to conduct abrasive perforating by pumping fluid into the bottom hole assembly at a first flow rate, the fluid applying hydraulic pressure against the pressure shoulder;

(c) further pumping fluid into the bottom hole assembly causing the mandrel to slide from the wellbore cleanout position to the perforating position, to abrasive perforate the wellbore utilizing the one or more jetting nozzles to erode through the surrounding production casing and into the surrounding subsurface formation;

(d) configuring the bottom hole assembly to conduct cleanout of the wellbore by pumping fluid into the bottom hole assembly at a second flow rate, causing the mandrel to slide from the perforating position to the wellbore cleanout position; and (e) further pumping fluid into the bottom hole assembly to clean out the wellbore.

22. The method of claim 21, wherein the method further comprises providing a J-slot mechanism responsive to the one or more flow rates in the bottom hole assembly to cycle between abrasive perforating and wellbore cleanout positions.

23. The method of claim 21, wherein the second flow rate is higher than the first flow rate.

24. The method of claim 21, wherein the second flow rate is lower than the first flow rate, and the method further comprises:

increasing the flow rate from the second flow rate to a rate higher than the first flow rate while still maintaining the mandrel in its open valve position, thereby enabling the bottom hole assembly to operate in a cleanout mode;

lowering the flow rate again back to its second flow rate; and increasing the flow rate back to its first flow rate, thereby moving the mandrel from its open valve position to its closed valve position and enabling the bottom hole assembly to again operate in a perforating mode.

25. The method of claim 24, further comprising:

changing a location of the bottom hole assembly before increasing the flow rate back to its first flow rate and operating in the perforating mode.

* * * * *

UNITED STATES PATENT AND TRADEMARK OFFICE

CERTIFICATE OF CORRECTION

PATENT NO. : 9,115,558 B2
APPLICATION NO. : 13/188526
DATED : August 25, 2015
INVENTOR(S) : Jonathan M. Stang It is certified that error appears in the above-identified patent and that said Letters Patent is hereby corrected as shown below:

Title Page, Item (75)

In the Inventor listing, the residence of Inventor Stang is incorrectly listed as "Macklin, CA (US)." The residence should read --Macklin, SK (CA)--.

In the Drawings

Sheet 5, Fig. 5, "resetable" should read --resettable--.

Sheet 10, Fig. 10, "resetable" should read --resettable--.

Sheet 11, Fig. 11, "resetable" should read --resettable--.

In the Specification

Column 3, line 56, the phrase "sand laden" should be --sand-laden--.

Column 4, line 10, the phrase "sand laden" should be --sand-laden--.

Figure 2:
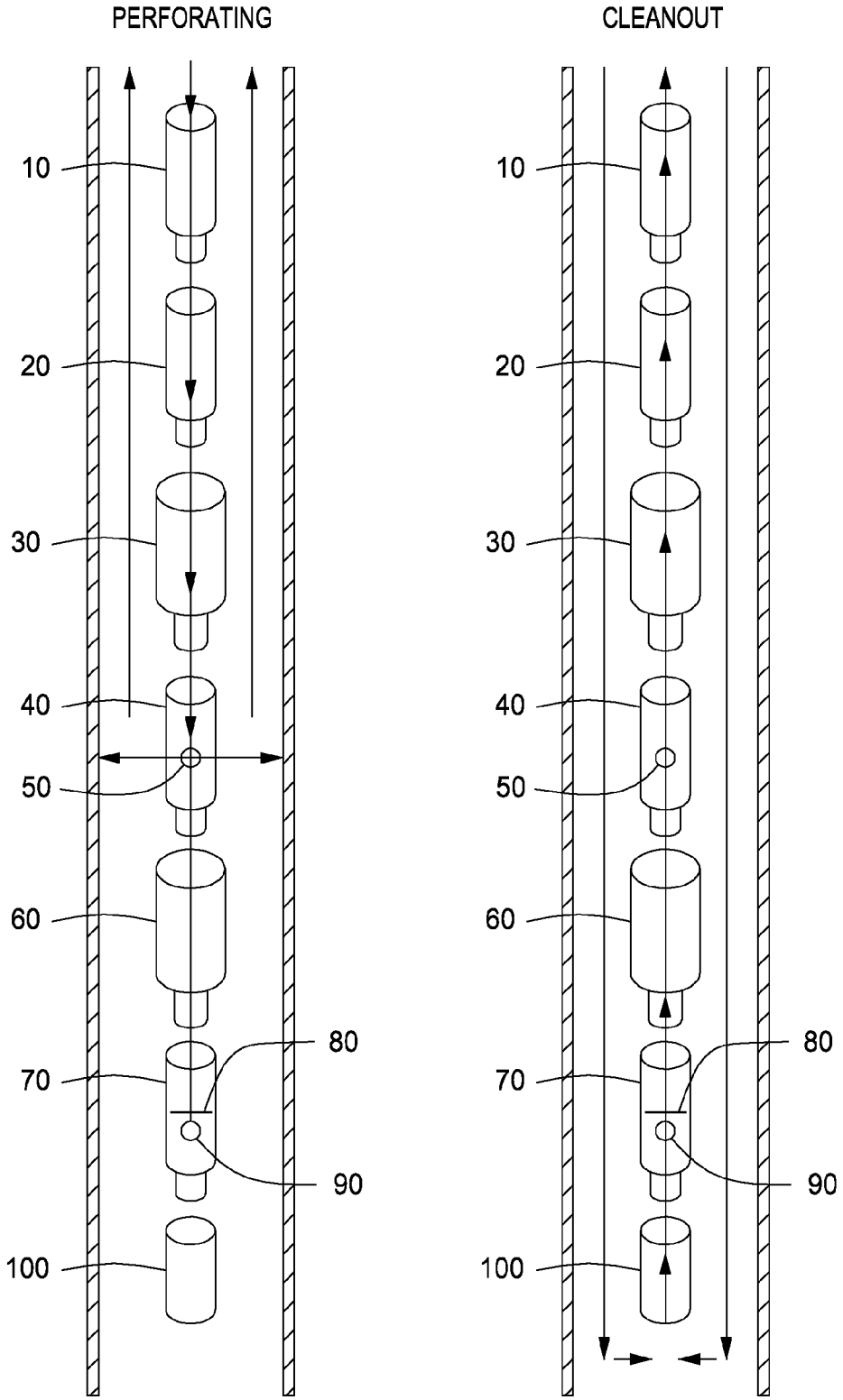
FIG. 2 (PRIOR ART)
FIG. 2 illustrates perforating and cleanout using the assembly previously illustrated in FIG. 1.

Column 4, line 62, the phrase "Fig. 2illustrates" should be --Fig. 2 illustrates--.

Column 5, line 3, the phrase "multi stage" should be --multi-stage--.

Column 6, line 27, the phrase "particular sequence of one of more rates" should be --particular sequence of one or more rates--.

Column 7, line 67, the phrase "would be required the isolating" should be --would be required, the isolating--.

Column 12, line 64, the word "provide" should be --provided--.

Signed and Sealed this
Fifth Day of July, 2016

Michelle K. Lee

Michelle K. Lee
*Director of the United States Patent and Trademark Office*